US010048614B2

(12) United States Patent
Takino

(10) Patent No.: US 10,048,614 B2
(45) Date of Patent: Aug. 14, 2018

(54) IMAGE FORMING APPARATUS THAT FORMS IMAGE USING LUMINESCENT TONER AND NON-LUMINESCENT TONER

(71) Applicant: Oki Data Corporation, Tokyo (JP)

(72) Inventor: Yuji Takino, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/600,144

(22) Filed: May 19, 2017

(65) Prior Publication Data

US 2017/0371270 A1 Dec. 28, 2017

(30) Foreign Application Priority Data

Jun. 24, 2016 (JP) ..... 2016-125757

(51) Int. Cl.
*G03G 15/00* (2006.01)
*G03G 15/08* (2006.01)

(52) U.S. Cl.
CPC ..... *G03G 15/08* (2013.01); *G03G 15/0822* (2013.01); *G03G 15/0832* (2013.01); *G03G 15/6585* (2013.01)

(58) Field of Classification Search
CPC ..... G03G 15/0824; G03G 15/08; G03G 15/0822; G03G 15/0832; H04N 1/04; H04N 1/32352; H04N 2201/3269
See application file for complete search history.

(56) References Cited

U.S. PATENT DOCUMENTS 6,666,991 B1 * 12/2003 Atarashi ..... B41M 3/144 106/400
2002/0018233 A1 * 2/2002 Mori ..... H04N 1/00238 358/1.15
2010/0277762 A1 * 11/2010 Eguchi ..... G03G 15/5016 358/1.15
2015/0116781 A1 * 4/2015 Tonami ..... H04N 1/00846 358/3.24
2017/0060024 A1 * 3/2017 Takano ..... G03G 15/0824
2017/0094102 A1 * 3/2017 Watanabe ..... G03G 15/50

FOREIGN PATENT DOCUMENTS

JP 2007-017719 A 1/2007
JP 2010-072643 A 4/2010

* cited by examiner

*Primary Examiner* — Francis Gray
(74) *Attorney, Agent, or Firm* — Muncy, Geissler, Olds & Lowe, P.C.

(57) ABSTRACT

An image forming apparatus includes first and second toner containers that respectively contains a non-luminescent toner and a luminescent toner, a first development part provided with the first toner container, and causing the non-luminescent toner, which is supplied from the first toner container, to adhere to a first latent image formed based on image data, a second development part provided with the second toner container, and causing the luminescent toner, which is supplied from the second toner container, to adhere to a second latent image formed based on the image data, which is used for the first latent image, a transfer part that transfers the non-luminescent toner adhering to the first latent image and the luminescent toner adhering to the second latent image to a medium, and a fuser part that fuses the non-luminescent toner and the luminescent toner transferred to the medium.

19 Claims, 4 Drawing Sheets

IMAGE FORMING APPARATUS THAT FORMS IMAGE USING LUMINESCENT TONER AND NON-LUMINESCENT TONER

CROSS REFERENCE TO RELATED APPLICATIONS

This application claims priority under 35 USC 119 to Japanese Patent Application No. 2016-125757 filed on Jun. 24, 2016 original document, the entire contents which are incorporated herein by reference.

TECHNICAL FIELD

This invention relates to an image forming apparatus that forms an image utilizing a toner development process.

BACKGROUND

Electrophotographic image forming apparatuses are commonly available. It is because clear images can be obtained in a short time in comparison with image forming apparatuses utilizing other systems such as the inkjet system.

An electrophotographic image forming apparatus is provided with a photosensitive drum and forms an image on the surface of a medium such as paper utilizing the photosensitive drum. In the image forming processes, after a latent image is formed on the surface of the photosensitive drum, toner is let adhere to the latent image. This toner adhering to this latent image is transferred to the medium and afterwards fused to the medium.

In order to form a color image, toner of at least one color is used. Besides this, toner that can emit light in response to the irradiation of ultraviolet light (luminescent toner) is also used (for example, see Patent Document 1).

[Patent Doc. 1] JP Laid-Open Application Publication 2007-017719

Because luminescent toner has a nature that it can easily discolor over time, in forming an image using the luminescent toner, it is desired that the image quality can be retained as long as possible.

This invention has been made considering such a problem, and its objective is to offer an image forming apparatus that can obtain high quality images.

SUMMARY

An image forming apparatus disclosed in the application comprise: a first toner container that contains a non-luminescent toner and a second toner container that contains a luminescent toner, the first and second toner containers being toners that are any other than a black toner; a first development part that is provided with the first toner container, and causes the non-luminescent toner, which is supplied from the first toner container, to adhere to a first latent image formed based on image data, a second development part that is provided with the second toner container, and causes the luminescent toner, which is supplied from the second toner container, to adhere to a second latent image formed based on the image data, which is used for the first latent image, a transfer part that transfers the non-luminescent toner adhering to the first latent image and the luminescent toner adhering to the second latent image to a medium, and a fuser part that fuses the non-luminescent toner and the luminescent toner transferred to the medium.

Here, "luminescent toner" is toner that generates visible light due to the absorption of the light. Specifically, that is toner that absorbs irradiation light and emits luminescent light. The irradiation light includes invisible light, such as ultraviolet light and infrared light, and visible light that is within near-ultraviolet region of the wavelength 400 nm or less. The irradiation light is to be composed with one or two more lights discussed above. Although the kind of the invisible light is not particularly limited, for example, it is at least one kind of ultraviolet light, infrared light, etc. Although the kind of the visible light is not particularly limited, for example, it is at least one kind of fluorescent light, noctilucent light, phosphorescent light, etc.

Also, "non-luminescent toner" is toner that does not generate visible light even upon receiving light such as invisible light unlike the above-mentioned luminescent toner.

With those structures, by a transfer part transferring non-luminescent and luminescent toner to a medium, and by a fuser part fusing the non-luminescent toner and the luminescent toner to the medium, a high-quality luminescent image can be obtained.

DETAILED DESCRIPTION OF PREFERRED EMBODIMENTS

Figure 1:
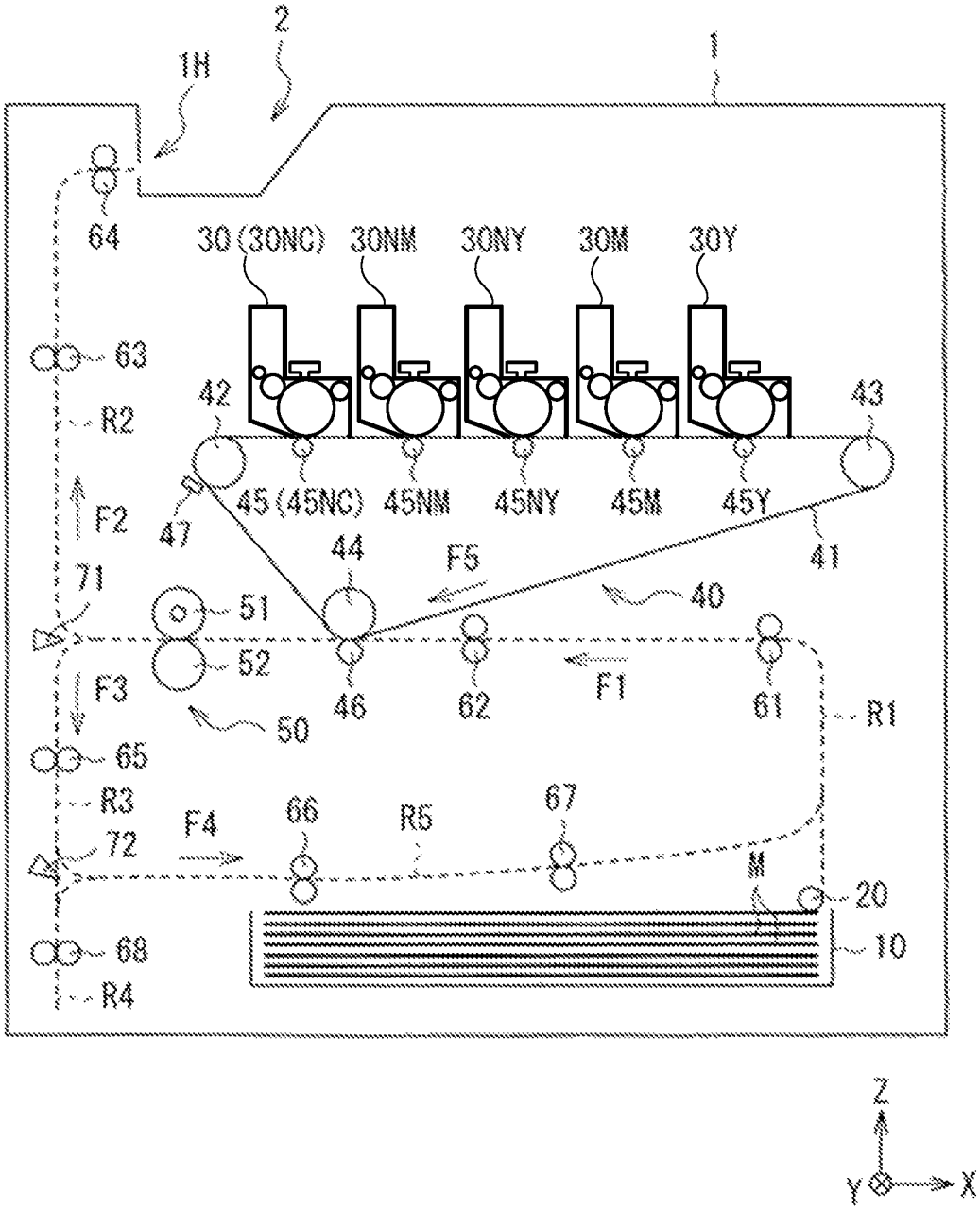
FIG. 1 is a plan view showing the configuration of an image forming apparatus of an embodiment of this invention.

Below, an embodiment of this invention is explained in detail referring to drawings. Note that the order of the explanation is as follows.

1. Image Forming Apparatus
   - 1-1. Overview
   - 1-2. Overall Configuration
   - 1-3. Development Part Configuration
   - 1-4. Toner Configuration
   - 1-5. Operations
   - 1-6. Actions and Effects
2. Modifications

1. Image Forming Apparatus

An image forming apparatus of an embodiment of this invention is explained.

1-1. Overview

First, an overview of the image forming apparatus is explained.

The image forming apparatus explained here is an electrophotographic full-color printer for example, and forms an image on the surface of a medium M (see FIG. 1 mentioned below) using non-luminescent toner and luminescent toner. Although the material of the medium M is not particularly limited, it is at least one kind of paper, film, etc. for example.

Because the kind (color) of the luminescent toner is not particularly limited, it can be either just one kind, two kinds, or more. Because the kind (color) of the non-luminescent toner is not particularly limited, it can be either just one kind, two kinds, or more. Although the material of the medium M is not particularly limited, it is at least one kind of paper, film, etc. for example.

As mentioned above, the "luminescent toner" is toner that generates visible light due to the absorption of the irradiation light. Although the kind of the invisible light is not particularly limited, it is at least one kind of ultraviolet light, infrared light, etc. for example. Although the kind of the visible light is not particularly limited, it is at least one kind of fluorescent light, noctilucent light, phosphorescent light, etc. for example.

The "non-luminescent toner" is toner that does not generate visible light even upon absorbing the irradiation light unlike the above-mentioned luminescent toner, and is so-called normal toner.

Below, luminescent toner and non-luminescent toner are also collectively called simply as "toner".

Especially, as mentioned below, this image forming apparatus can form an image using only luminescent toner and can also form an image using non-luminescent toner together with the luminescent toner. Accompanying this, the image forming apparatus has multiple image forming modes for example.

Specifically, the image forming apparatus has two kinds of image forming modes (normal mode and light resistance UP mode) for example. The normal mode is an image forming mode where only the luminescent toner is used for forming an image. The light resistance UP mode is an image forming mode where the non-luminescent toner is used together with the luminescent toner for forming an image. This light resistance UP mode can include multiple image forming modes having different conditions such as coverage rate according to the required levels of light resistance etc. Note that the coverage rate is so-called the duty ratio.

A quantity η defined below is called the coverage rate.

$$\eta = Sb/Sa \times 100(\%)$$

Sa: maximum area on which an exposure device (LED head) is able to expose within a unit region (for example, a single page or single sheet). In other words, the area may be defined as an area where a solid image 11 is formed.

Sb: exposed area on which the exposure device actually exposed in the unit region. The area may be defined as an area where a toner image is actually formed.

In the above embodiment, LED head is used for the exposure device. That is an example. Other heads that have been used for the exposure device as of when the invention was made, such as a laser head, may be available.

The normal mode is used for applications that do not require much light resistance to the image for example. The applications of the normal mode are, for example, simply forming an image on the surface of the medium M, etc. On the other hand, the light resistance UP mode is used for applications that require sufficient light resistance to the image for example. The applications of the light resistance UP mode are, for example, forming an authentication image that requires retaining the image quality, forming an image that tends to be exposed to direct sunlight, etc. The latter image is, for example, an image etc. used for so-called a T-shirt printing application, etc., and more specifically an image etc. for a design application formed on the surface of a T shirt.

1-2. Overall Configuration

Next, explained is the overall configuration of the image forming apparatus.

FIG. 1 shows the planar configuration of the image forming apparatus. The medium M is carried along carrying routes R1-R5. In FIG. 1, each of the carrying routes R1-R5 is shown in a broken line.

As shown in FIG. 1, this image forming apparatus is provided with, for example, a tray 10, a forwarding roller 20, at least one development part 30, a transfer part 40, a fuser part 50, carrying rollers 61-68, and carrying route switching guides 71 and 72 inside a chassis 1.

[Chassis]

The chassis 1 contains at least one kind of metallic materials, macromolecular materials, etc. for example. The chassis 1 is provided with a stacker part 2 for ejecting the medium M having an image formed, and the medium M having the image formed is ejected through an ejection part 1H provided on the chassis 1.

[Tray and Forwarding Roller]

The tray 10 is attached to the chassis 1 in a detachable manner, for example, and contains the medium M. The forwarding roller 20 extends in the Y-axis direction, for example, and can rotate centering on the Y axis. Among a series of components explained below, the components containing "roller" in their names extend in the Y-axis direction and can rotate centering on the Y axis.

In the tray 10, for example, multiple media M are contained in a stacked state. The multiple media M contained in this tray 10 are extracted one by one from the tray 10 by the forwarding roller 20 for example.

Because the number of the trays 10 and the number of the forwarding rollers 20 are not particularly limited, they can be either just one, two, or more. Shown in FIG. 1 for example is the case where the number of the trays 10 is one, and the number of the forwarding rollers 20 is one.

[Development Part]

The development part 30 uses toner to perform an adherence process (development process) of the toner. Specifically, the development part 30 forms a latent image (an electrostatic latent image) and also utilizes a Coulomb force to let the toner adhere to the latent image.

As mentioned above, this toner contains non-luminescent toner and luminescent toner. The details of the non-luminescent toner and the luminescent toner are mentioned below.

Here, the image forming apparatus is provided with, for example, five development parts 30. The five development parts 30 include three development parts (30NC, 30NM, and 30NY) that are second development parts to perform development processes using luminescent toner, and two development parts 30 (30M and 30Y) that are first development parts to perform development processes using non-luminescent toner.

The development parts 30NC, 30NM, 30NY, 30M, and 30Y are, for example, attached to the chassis 1 in a detachable manner and also disposed along the moving route of an intermediate transfer belt 41 mentioned below. Here, the development parts 30NC, 30NM, 30NY, 30M, and 30Y are, for example, disposed from the upstream side toward the downstream side in this order in the moving direction of the intermediate transfer belt 41 (an arrow F5).

The development parts 30NC, 30NM, 30NY, 30M, and 30Y have the same configuration as one another except that the kind (color) of the toner contained in a cartridge 38 (or toner container, see FIG. 2) mentioned below for example. The individual configurations of the development parts 30NC, 30NM, 30NY, 30M, and 30Y are mentioned below.

[Transfer Part]

The transfer part 40 performs a transfer process using the toner development-processed by the development part 30. Specifically, the transfer part 40 transfers the toner adhering to the electrostatic latent image by the development part 30 to the medium M.

This transfer part 40 includes, for example, an intermediate transfer belt 41, a drive roller 42, a driven roller (idle roller) 43, a backup roller 44, at least one primary transfer roller 45, a secondary transfer roller 46, and a cleaning blade 47.

The intermediate transfer belt 41 is a medium (an intermediate transfer medium) to which toner is temporarily transferred before the toner is transferred to the medium M, and is an endless elastic belt or the like for example. This intermediate transfer belt 41 contains at least one kind of macromolecular materials such as polyimide for example. Note that in a state of being stretched by the drive roller 42, the driven roller 43, and the backup roller 44, the intermediate transfer belt 41 can move according to the rotation of the drive roller 42.

The drive roller 42 can rotate through a drive source such as a motor for example. Each of the driven roller 43 and the backup roller 44 can rotate according to the rotation of the drive roller 42 for example.

The primary transfer roller 45 transfers (primary-transfers) the toner adhering to the electrostatic latent image to the intermediate transfer belt 41. This primary transfer roller 45 is in press-contact with the development part 30 (photosensitive drum 31 mentioned below: see FIG. 2) through the intermediate transfer belt 41. Note that the primary transfer roller 45 can rotate according to the movement of the intermediate transfer belt 41.

Here, the transfer part 40 includes five primary transfer rollers 45 (45NC, 45NM, 45NY, 45M, and 45Y) corresponding to the above-mentioned five development parts 30 (30NC, 30NM, 30NY, 30M, and 30Y). Also, the transfer part 40 includes one secondary transfer roller 46 corresponding to one backup roller 44.

The secondary transfer roller 46 transfers (secondary-transfers) the toner transferred to the intermediate transfer belt 41 to the medium M. This secondary transfer roller 46 is in press-contact with the backup roller 44, and comprises a metallic core and an elastic layer such as a foamed rubber layer covering the outer circumference of the core for example. Note that the secondary transfer roller 46 can rotate according to the movement of the intermediate transfer belt 41.

The cleaning blade 47 is in press-contact with the intermediate transfer belt 41, and scrapes off unnecessary toner etc. remaining on the surface of the intermediate transfer belt 41.

[Fuser Part]

The fuser part 50 performs a fusing process using the toner transferred to the medium M by the transfer part 40. Specifically, for example, the fuser part 50 applies heat and a pressure to the toner transferred to the medium M by the transfer part 40, thereby fusing the toner to the medium M.

This fuser part 50 includes a heat application roller 51 and a pressure application roller 52 for example.

The heat application roller 51 heats the toner. This heat application roller 51 comprises, for example, a metal core in a hollow cylindrical shape, and a resin coating covering the surface of the metal core. The metal core contains at least one kind of metallic materials such as aluminum for example. The resin coating contains, for example, at least one kind of macromolecular materials such as copolymer of tetrafluoroethylene and perfluoroalkylvinylether (PFA) and polytetrafluoroethylene (PTFE).

Installed inside the heat application roller 51 (metal core) is, for example, a heater such as a halogen lamp. The surface temperature of the heat application roller 51 is detected, for example, by a thermistor disposed in a position away from the heat application roller 51.

The pressure application roller 52 is in press-contact with the heat application roller 51 and applies a pressure to the toner. This pressure application roller 52 is, for example, a metal bar or the like. The metal bar contains, for example, at least one kind of metallic materials such as aluminum.

[Carrying Rollers]

Each of the carrying rollers 61-68 comprises a pair of rollers disposed so as to oppose each other through the carrying routes R1-R5 of the medium M, and carries the medium M extracted by the forwarding roller 20.

When an image is formed on only one side of the medium M, the medium M is carried along the carrying routes R1 and R2 by the carrying rollers 61-64 for example. Also, when images are formed on both sides of the medium M, the medium M is carried along the carrying routes R1-R5 by the carrying rollers 61-68 for example.

[Carrying Route Switching Guide]

The carrying route switching guides 71 and 72 switch the carrying direction of the medium M according to such conditions as the mode (whether an image is formed on only one side of the medium M or images are formed on both sides of the medium M) of an image formed on the medium M.

[Other Components]

Note that the image forming apparatus can be provided with, for example, at least one kind of other components than those mentioned above. Although the other components are not particularly limited, they are a control part that controls the whole operations of the image forming apparatus, an operation panel that the user can use for operating the image forming apparatus, etc. This control part includes electronic circuits such as a central processing unit (CPU) for example.

1-3. Development Part Configuration

Figure 2:
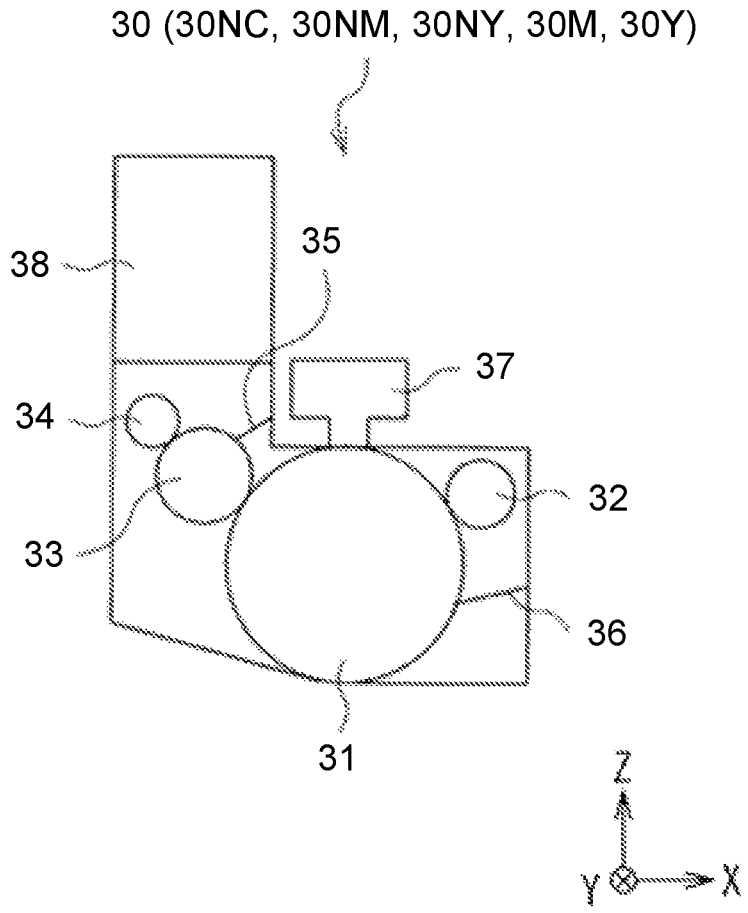
FIG. 2 is a plan view showing an enlarged view of the configuration of a development part shown in FIG. 1.

Next, explained is the configuration of the development part 30. FIG. 2 is an enlarged view of the planar configuration of the development part 30 shown in FIG. 1.

Each of the development parts 30NC, 30NM, 30NY, 30M, and 30Y includes, as shown in FIG. 2 for example, a photosensitive drum 31, a charging roller 32, a development roller 33, a supply roller 34, a development blade 35, a cleaning blade 36, a light emitting diode (LED) head 37, and a cartridge 38.

[Photosensitive Drum]

The photosensitive drum 31 is, for example, an organic photosensitive body comprising a cylindrical conductive supporting body and a photoconductive layer coating the outer circumferential face of the conductive supporting body, and can rotate through a drive source such as a motor. The conductive supporting body is, for example, a metal pipe containing at least one kind of metallic materials such as aluminum. The photoconductive layer is, for example, a laminated body comprising a charge generation layer, a charge transportation layer, etc.

[Charging Roller]

The charging roller 32 comprises, for example, a metal shaft and a semiconductive epichlorohydrin rubber layer covering the outer circumferential face of the metal shaft. This charging roller 32 is in press-contact with the photosensitive drum 31 for charging the photosensitive drum 31.

[Development Roller]

The development roller 33 comprises, for example, a metal shaft and a semiconductive urethane rubber layer covering the outer circumferential face of the metal shaft. This development roller 33 carries toner supplied from the supply roller 34 and also lets the toner adhere to the electrostatic latent image formed on the surface of the photosensitive drum 31.

[Supply Roller]

The supply roller 34 comprises, for example, a metal shaft and a semiconductive foaming silicone sponge layer covering the outer circumferential face of the metal shaft. This supply roller 34 supplies toner to the surface of the photosensitive drum 31 while slide-contacting with the development roller 33.

[Development Blade]

The development blade 35 regulates the thickness of toner supplied to the surface of the development roller 33. This development blade 35 is, for example, disposed in a position separated by a predetermined distance from the development roller 33, and the toner thickness is controlled based on the distance between the development roller 33 and the development blade 35. Also, the development blade 35 contains, for example, at least one kind of metallic materials such as stainless steel.

[Cleaning Blade]

The cleaning blade 36 scrapes off unnecessary toner remaining on the surface of the photosensitive drum 31. This cleaning blade 36, for example, extends in an approximately parallel direction to the extending direction of the photosensitive drum 31, and is in press-contact with the photosensitive drum 31. Also, the cleaning blade 36 contains, for example, at least one kind of macromolecular materials such as urethane rubber.

[LED Head]

The LED head 37 is an exposure device that forms an electrostatic latent image on the surface of the photosensitive drum 31 by exposing the surface of the photosensitive drum 31 to light, and comprises LED elements, a lens array, etc. for example. The LED elements and the lens array are disposed so that light (irradiation light) output from the LED elements forms an image on the surface of the photosensitive drum 31.

[Cartridge]

The cartridge 38 is detachable for example, and contains toner. The kind (color) of the toner contained in the cartridge 38 is as follows for example.

Here, for example, the luminescent toner is fluorescent toner that generates fluorescent light in response to ultraviolet light or the like. Accompanying this, the cartridge 38 of the development part 30NC contains fluorescent cyan toner that is luminescent toner for example. The cartridge 38 of the development part 30NM contains fluorescent magenta toner that is luminescent toner for example. The cartridge 38 of the development part 30NY contains fluorescent yellow toner that is luminescent toner for example.

The cartridge 38 of the development part 30M contains magenta toner that is non-luminescent toner for example. The cartridge 38 of the development part 30Y contains yellow toner that is non-luminescent toner for example.

The fluorescent cyan toner, the fluorescent magenta toner, and the fluorescent yellow toner, that are luminescent toner, are used for forming a luminescent image. On the other hand, the magenta toner and the yellow toner, that are non-luminescent toner, are used for forming a non-luminescent image.

As is evident from the fact of being formed using luminescent toner, a "luminescent image" is an image that generates visible light utilizing the luminescent toner. As opposed to this, as is evident from the fact of being formed using non-luminescent toner, unlike the above-mentioned luminescent image, a "non-luminescent image" is an image that does not generate visible light even upon receiving light such as invisible light, and is so-called a normal image.

1-4. Toner Configuration

Next, explained is the configuration of toner.

[Kinds of Toner]

Here, as mentioned above for example, five kinds of toner are used. Specifically, for example, three kinds of luminescent toner (fluorescent cyan toner, fluorescent magenta toner, and fluorescent yellow toner) and two kinds of non-luminescent toner (magenta toner and yellow toner) are used.

The reason why there are two kinds of non-luminescent toner whereas there are three kinds of luminescent toner is, for example, that whereas the fluorescent magenta toner and the fluorescent yellow toner are easy to discolor, the fluorescent cyan toner is hard to discolor as mentioned below.

To be in more detail, the fluorescent magenta toner that is luminescent toner essentially has a nature of being easy to discolor. Accompanying this, in forming a magenta-color image, not only forming a magenta-color luminescent image using the fluorescent magenta toner, it is preferred to compensate for the magenta color in that image by forming a magenta-color non-luminescent image using the magenta toner that is non-luminescent toner. Therefore, in order to form a magenta-color image, the fluorescent magenta toner that is luminescent toner and the magenta toner that is non-luminescent toner are used together.

In the same manner, the fluorescent yellow toner that is luminescent toner essentially has a nature of being easy to discolor. Accompanying this, in forming an yellow-color image, not only forming an yellow-color luminescent image using the fluorescent yellow toner, it is preferred to compensate for the yellow color in that image by forming an yellow-color non-luminescent image using the yellow toner that is non-luminescent toner. Therefore, in order to form an yellow-color image, the fluorescent yellow toner that is luminescent toner and the yellow toner that is non-luminescent toner are used together.

As opposed to this, the fluorescent cyan toner that is luminescent toner essentially has a nature of being hard to discolor. Accompanying this, in forming a cyan-color image, because forming a cyan-color luminescent image using the fluorescent cyan toner is sufficient, there is no need to compensate for the cyan color in the image using the cyan toner that is non-luminescent toner. Therefore, in order to form a cyan-color image, instead of using the cyan toner that is non-luminescent toner, only the fluorescent cyan toner that is luminescent toner is used.

Toner explained here is, for example, toner of the one-component development system, and more specifically, negatively-charged toner.

The one-component development system is a system where an appropriate amount of charge is given to toner without using a carrier (magnetic particles) for giving a charge to the toner. As opposed to this, the two-component development system is a system where an appropriate amount of charge is given to toner by mixing the above-mentioned carrier and the toner and utilizing friction between the carrier and the toner.

[Fluorescent Cyan Toner]

The fluorescent cyan toner contains a cyan coloring agent and a fluorescent whitening agent for example. Note that the fluorescent cyan toner can contain at least one kind of other materials together with the above-mentioned cyan coloring agent and fluorescent whitening agent.

The cyan coloring agent contains at least one kind of cyan pigment, cyan dye (coloring matter), etc. for example. The cyan pigment is, for example, phthalocyanine blue (C. I. Pigment Blue 15:3) or the like. The cyan dye is, for example, Pigment Blue 15:3 or the like. Although the content of the cyan coloring agent is not particularly limited, for example, it is 2-25 pts. wt., preferably 2-15 pts. wt. for the content of a binding agent mentioned below (100 pts. wt.).

The fluorescent whitening agent contains at least one kind of stilbene-based compound, coumarin-based compound, biphenyl-based compound, etc. for example. Although the content of the fluorescent whitening agent is not particularly limited, for example, it is 2-25 pts. wt., preferably 2-15 pts. wt. for the content of the binding agent mentioned below (100 pts. wt.).

Although the kinds of other materials are not particularly limited, for example, they are a binding agent, an external additive, a release agent, a charge control agent, etc.

The binding agent mainly binds the fluorescent cyan coloring agent, etc. This binding agent contains, for example, at least one kind of macromolecular compounds such as polyester-based resin, styrene-acryl-based resin, epoxy-based resin, and styrene-butadiene-based resin.

Among them, the binding agent should preferably contain a polyester-based resin. The reason is as follows. Because polyester-based resin has high affinity to the medium M such as paper, toner containing polyester-based resin as a binding agent becomes easy to be fused to the medium M. Also, because polyester-based resin has high physical strength even if having relatively small molecular weight, toner containing polyester-based resin as a binding agent has excellent durability.

This polyester-based resin is, for example, a reaction product (polycondensed matter) of at least one alcohol and at least one carboxylic acid.

Although the kind of alcohol is not particularly limited, among all, it should preferably be polyhydric alcohol, its derivative, or the like. This polyhydric alcohol is, for example, ethylene glycol, diethylene glycol, triethylene glycol, polyethylene glycol, propylene glycol, butanediol, pentanediol, hexanediol, cyclohexanedimethanol, xylene glycol, diprolylene glycol, polypropylene glycol, bisphenol A, hydrogenated bisphenol A, bisphenol-A ethylene oxide, bisphenol-A propylene oxide, sorbitol, glycerin, or the like.

Although the kind of carboxylic acid is not particularly limited, among all, it should preferably be polyhydric carboxylic acid, its derivative, or the like. This polyhydric carboxylic acid is, for example, maleic acid, fumaric acid, phthalic acid, isophthalic acid, terephthalic acid, succinic acid, adipic acid, trimellitic acid, pyromellitic acid, cyclopentanedicarboxylic acid, succinic anhydride, trimellitic anhydride, maleic anhydride, dodecenylsuccinic anhydride, or the like.

The external additive mainly improves flowability of the fluorescent cyan toner by suppressing agglomeration of the fluorescent cyan toner particles. This external additive contains, for example, at least one kind of inorganic materials, organic materials, etc. The inorganic materials are, for example, hydrophobic silica, etc. The organic materials are, for example, melamine resin, etc. Although the content of the external additive is not particularly limited, for example, it is 0.01-10 pts. wt., preferably 0.05-8 pts. wt. for the content of the binding agent (100 pts. wt.).

The release agent mainly improves fusibility and offset resistance of the fluorescent cyan toner. This release agent contains, for example, at least one kind of waxes such as aliphatic hydrocarbon-based wax, oxidized matter of aliphatic hydrocarbon-based wax, fatty acid ester-based wax, and deoxidized matter of fatty acid ester-based wax. Besides, the release agent can be a block copolymer of the above-mentioned series of waxes. Although the content of the release agent is not particularly limited, for example, it is 0.1-20 pts. wt., preferably 0.5-12 pts. wt. for the content of the binding agent (100 pts. wt.).

The aliphatic hydrocarbon-based wax is, for example, low molecular weight polyethylene, low molecular weight polypropylene, olefin copolymer, microcrystalline wax, paraffin wax, Fischer-Tropsch wax, or the like. The oxidized matter of aliphatic hydrocarbon-based wax is, for example, oxidized polyethylene wax or the like. The fatty acid ester-based wax is, for example, carnauba wax, montanic acid ester wax, or the like. The deoxidized matter of fatty acid ester-based wax is a wax having part or whole of its fatty acid ester-based wax deoxidized, and is deoxidized carnauba wax or the like for example.

The charge control agent mainly controls the friction charging property of the fluorescent cyan toner or the like. The charge control agent used for negatively-charged toner contains, for example, at least one kind of azo-series complex, salicylic acid-series complex, calixarene-series complex, etc. Although the content of the charge control agent is not particularly limited, for example, it is 0.05-15 pts. wt. for the content of the binding agent (100 pts. wt.).

[Fluorescent Magenta Toner]

The fluorescent magenta toner has almost the same configuration as the fluorescent cyan toner except for containing one or both of a magenta coloring agent and a fluorescent magenta coloring agent substituting for the cyan coloring agent for example.

The magenta coloring agent contains, for example, at least one kind of magenta pigment, magenta dye (coloring matter), etc. The magenta pigment is, for example, quinacridone or the like. The magenta dye is, for example, C. I. Pigment Red 238 or the like.

The fluorescent magenta coloring agent that is a fluorescent coloring agent contains, for example, at least one kind of fluorescent magenta pigment, fluorescent magenta dye (coloring matter), etc. This fluorescent magenta coloring agent is, for example, a fluorescent coloring agent (SX-100 series or SX-1000 series) manufactured by SINLOIHI Co., Ltd. or the like.

Note that if the fluorescent magenta toner contains a fluorescent magenta coloring agent, because fluorescence is performed by the fluorescent magenta coloring agent, the fluorescent magenta toner need not contain a fluorescent whitening agent. On the other hand, if the fluorescent magenta toner contains a magenta coloring agent, in order to secure fluorescence, the fluorescent magenta toner can contain a fluorescent whitening agent.

[Fluorescent Yellow Toner]

The fluorescent yellow toner has almost the same configuration as the fluorescent cyan toner except for containing one or both of a yellow coloring agent and a fluorescent yellow coloring agent substituting for the cyan coloring agent for example.

The yellow coloring agent contains, for example, at least one kind of yellow pigment, yellow dye (coloring matter), etc. The yellow pigment is, for example, Pigment Yellow 74 or the like. The yellow dye is, for example, C. I. Pigment Yellow 74, cadmium yellow, or the like.

The fluorescent yellow coloring agent that is a fluorescent coloring agent contains, for example, at least one kind of fluorescent yellow pigment, fluorescent yellow dye (coloring matter), etc. This fluorescent yellow coloring agent is, for example, a fluorescent coloring agent (SX-100 series or SX-1000 series) manufactured by SINLOIHI Co., Ltd. or the like.

Note that if the fluorescent yellow toner contains a fluorescent yellow coloring agent, because fluorescence is performed by the fluorescent yellow coloring agent, the fluorescent yellow toner need not contain a fluorescent whitening agent. On the other hand, if the fluorescent yellow toner contains a yellow coloring agent, in order to secure fluorescence, the fluorescent yellow toner can contain a fluorescent whitening agent.

[Magenta Toner]

The magenta toner has almost the same configuration as the fluorescent magenta toner except for not containing a fluorescent magenta coloring agent but containing a magenta coloring agent as well as not containing a fluorescent whitening agent for example. Note that the magenta coloring agent contained in the magenta toner and the magenta coloring agent contained in the fluorescent magenta toner can be either the same kind or different kinds.

[Yellow Toner]

The yellow toner has almost the same configuration as the fluorescent yellow toner except for not containing a fluorescent yellow coloring agent but containing a yellow coloring agent as well as not containing a fluorescent whitening agent for example. Note that the yellow coloring agent contained in the yellow toner and the yellow coloring agent contained in the fluorescent yellow toner can be either the same kind or different kinds.

Note that the manufacturing method of toner is not particularly limited. This manufacturing method can be the pulverization method, the polymerization method, or another method than those. Of course, two kinds or more of the above-mentioned manufacturing methods can be used together. The polymerization method is, for example, the dissolution suspension method or the like.

1-5. Operations

Next, explained are the operations of the image forming apparatus.

Figure 3:
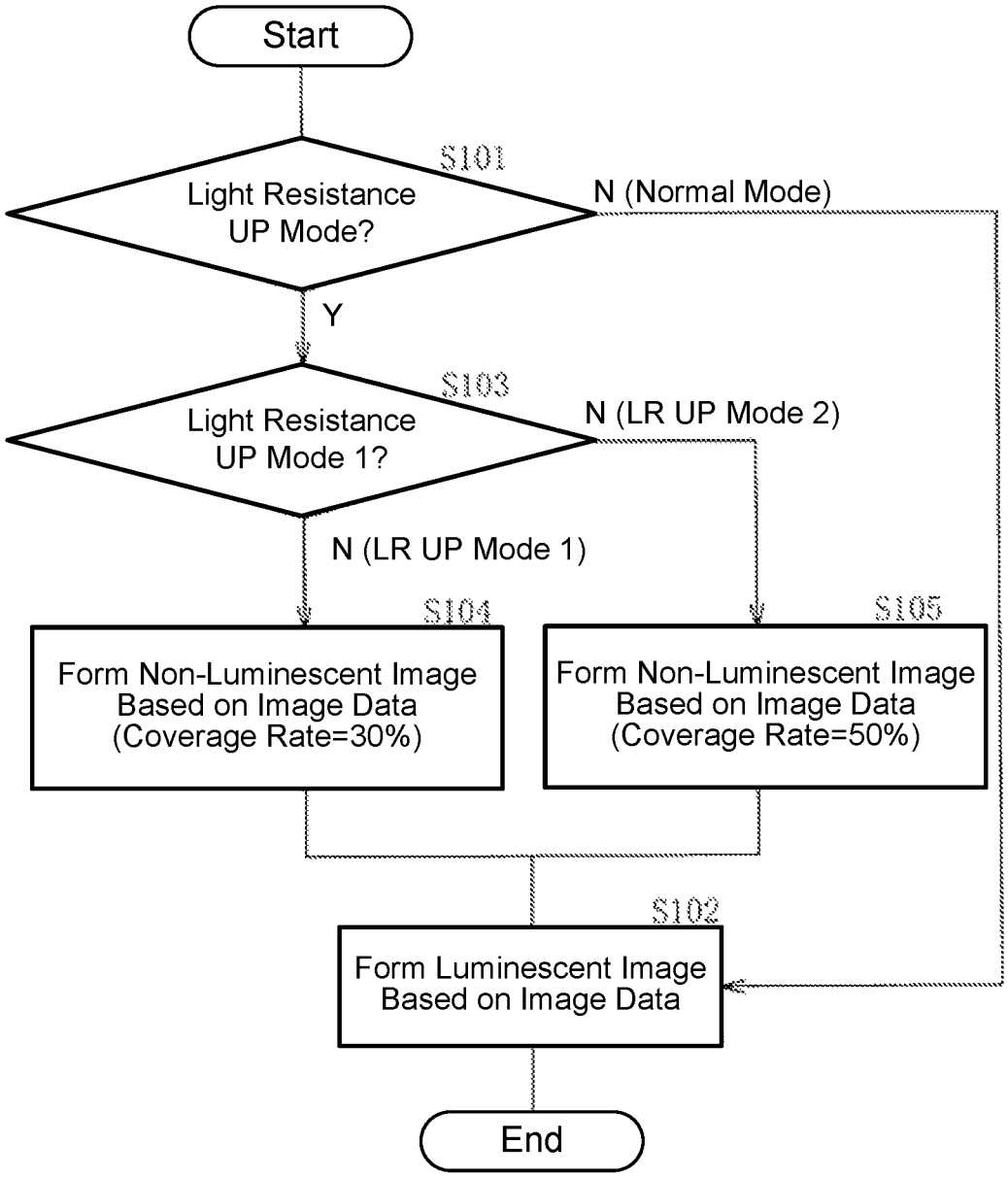
FIG. 3 is a flow chart for explaining the operations of the image forming apparatus of an embodiment of this invention.
Figure 4:
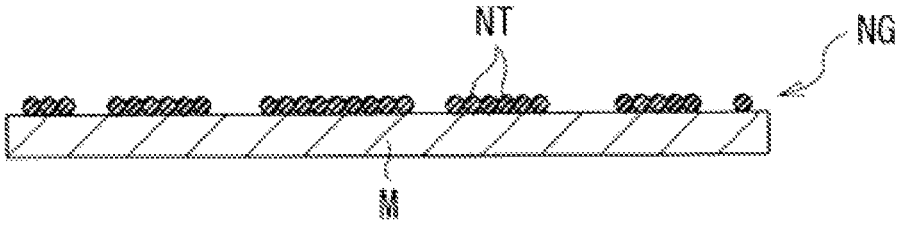
FIG. 4 is a cross-sectional view for explaining the configuration of an image formed by the image forming apparatus of an embodiment of this invention.
Figure 5:
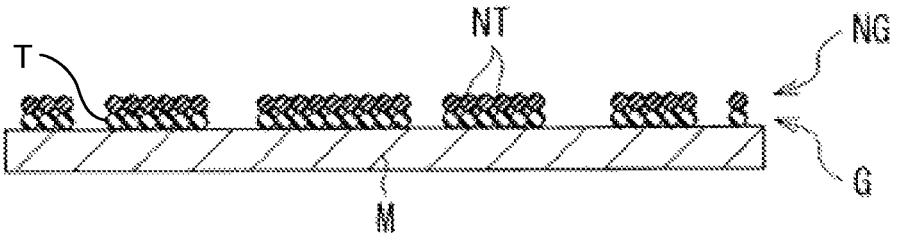
FIG. 5 is a cross-sectional view for explaining the configuration of another image formed by the image forming apparatus of an embodiment of this invention.

FIG. 3 shows a flow for explaining the operations of the image forming apparatus. Each of FIGS. 4 and 5 shows a cross-sectional configuration of the medium M for explaining the configuration of an image formed by the image forming apparatus. Shown in FIG. 4 is the case where an image (luminescent image NG) is formed using only luminescent toner NT, and shown in FIG. 5 is the case where images (a luminescent image NG and a non-luminescent image G) are formed using non-luminescent toner T together with the luminescent toner NT.

Below, cited as an example is the case where the image forming apparatus performs an image forming operation in the normal mode or the light resistance UP mode, and the light resistance UP mode includes two stages of the image forming mode (light resistance UP modes 1 and 2). Step numbers in parentheses explained below correspond to the step numbers shown in FIG. 3.

[Mode Selection]

Before forming an image, the user selects whether to use the light resistance UP mode as the image forming mode by operating the operation panel built on the image forming apparatus for example (S101).

[Normal Mode Image Formation]

If the user did not select the light resistance UP mode (S101N), the image forming apparatus forms an image by performing the normal image forming operation based on image data D (S102). The image data D are data used by the image forming apparatus for forming an image, and are supplied to the image forming apparatus from an external terminal device or the like for example. The external terminal device is, for example, a personal computer or the like that can be used by the user.

Specifically, as explained below for example, the image forming apparatus performs image forming processes (a development process, a primary transfer process, a secondary transfer process, and the fusing process) using only the luminescent toner based on the image data D, and also performs a cleaning process as necessary.

(Development Process)

The medium M contained in the tray 10 is extracted by the forwarding roller 20. The medium M extracted by this forwarding roller 20 is carried in the direction of an arrow F1 along a carrying route R1 by the carrying rollers 61 and 62.

In the development process, in the development part 30NC, once the photosensitive drum 31 rotates, the charging roller 32 applies a DC voltage to the surface of the photosensitive drum 31 while rotating. Thereby, the surface of the photosensitive drum 31 is uniformly charged.

Subsequently, based on the image data D, the LED head 37 irradiates the surface of the photosensitive drum 31 with light. Thereby, on the surface of the photosensitive drum 31, because the surface potential is attenuated (photo-induced discharge) on the light-irradiated portion, an electrostatic latent image is formed on the surface of the photosensitive drum 31.

On the other hand, in the development part 30NC, the luminescent toner NT (fluorescent cyan toner) contained in the cartridge 38 is discharged toward the supply roller 34.

After a voltage is applied to the supply roller 34, the supply roller 34 rotates. Thereby, the fluorescent cyan toner is supplied from the cartridge 38 to the surface of the supply roller 34.

After a voltage is applied to the development roller 33, the development roller 33 rotates while in press-contact with the supply roller 34. Thereby, because the fluorescent cyan toner supplied to the surface of the supply roller 34 is adsorbed onto the surface of the development roller 33, the fluorescent cyan toner is carried utilizing the rotation of the development roller 33. In this case, because part of the fluorescent cyan toner adsorbed on the surface of the development roller 33 is removed by the development blade 35, the thickness of the fluorescent cyan toner adsorbed on the surface of the development roller 33 is homogenized.

After the photosensitive drum 31 rotated while in press-contact with the development roller 33, the fluorescent cyan toner adsorbed on the surface of the development roller 33 migrates to the surface of the photosensitive drum 31. Thereby, the fluorescent cyan toner adheres to the surface of the photosensitive drum 31 (electrostatic latent image).

(Primary Transfer Process)

In the transfer part 40, once the drive roller 42 rotates, the driven roller 43 and the backup roller 44 rotate according to the rotation of the drive roller 42. Thereby, the intermediate transfer belt 41 moves in the direction of the arrow F5.

In the primary transfer process, a voltage is applied to the primary transfer roller 45NC. Because this primary transfer roller 45NC is in press-contact with the photosensitive rum 31 through the intermediate transfer belt 41, the fluorescent cyan toner adhering to the surface of the photosensitive drum 31 (electrostatic latent image) in the above-mentioned development process is transferred to the surface of the intermediate transfer belt 41.

Thereafter, the intermediate transfer belt 41 having the fluorescent cyan toner transferred to continues to move in the direction of the arrow F5. Thereby, in the development parts 30NM and 30NY and on the primary transfer rollers 45NM and 45NY, the development processes and the primary transfer processes are performed following the same procedure as in the development part 30NC and on the primary transfer roller 45NC mentioned above. Therefore, other luminescent toner NT (the fluorescent magenta toner or the fluorescent yellow toner) are transferred to the surface of the intermediate transfer belt 41.

Specifically, the fluorescent magenta toner is transferred to the surface of the intermediate transfer belt 41 by the development part 30NM and the primary transfer roller 45NM. Subsequently, the fluorescent yellow toner is transferred to the surface of the intermediate transfer belt 41 by the development part 30NY and the primary transfer roller 45NY.

Of course, whether the development process and the primary transfer process are actually performed in each of the development parts 30NC, 30NM, and 30NY, and on each of the primary transfer rollers 45NC, 45NM, and 45NY is determined according to the necessary colors (combination of colors) for forming an image.

(Secondary Transfer Process)

The medium M carried along the carrying route R1 passes between the backup roller 44 and the secondary transfer roller 46.

In the secondary transfer process, a voltage is applied to the secondary transfer roller 46. Because this secondary transfer roller 46 is press-contact with the backup roller 44 through the medium M, the luminescent toner NT transferred to the intermediate transfer belt 41 in the primary transfer process mentioned above is transferred to the medium M.

(Fusing Process)

After the luminescent toner NT is transferred to the medium M in the secondary transfer process, because the medium M continues to be carried in the direction of the arrow F1 along the carrying route R1, it is injected to the fuser part 50.

In the fusing process, the surface temperature of the heat application roller 51 is controlled to become predetermined temperature. Once the pressure application roller 52 rotates while in press-contact with the heat application roller 51, the medium M is carried so as to pass between the heat application roller 51 and the pressure application roller 52.

Thereby, because the luminescent toner NT transferred to the surface of the medium M is heated, the luminescent toner NT melts. In addition, because the luminescent toner NT in a molten state is in press-contact with the medium M, the luminescent toner NT strongly adheres to the medium M.

Therefore, as shown in FIG. 4, because the luminescent toner NT is fused so as to become a specific pattern in a specific region on the surface of the medium M, an image (a luminescent image NG) is formed.

The medium M having the image formed is carried in the direction of an arrow F2 by the carrying rollers 63 and 64 along a carrying route R2. Thereby, the medium M is ejected from an ejection port 1H to the stacker part 2.

Note that the carrying procedure of the medium M is changed according to the mode of the image formed on the surface of the medium M.

For example, if images are formed on both sides of the medium M, the medium M that passed through the fuser part 50 is carried in the directions of arrows F3 and F4 by the carrying rollers 65-68 along the carrying routes R3-R5, and afterwards carried in the direction of the arrow F1 again by the carrying rollers 61 and 62 along the carrying route R1. In this case, the direction that the medium M is carried is controlled by the carrying path switching guides 71 and 72. Thereby, on the back face of the medium M (the face where no image is formed yet), the image forming processes (the development process, the primary transfer process, the secondary transfer process, and the fusing process) are performed.

(Cleaning Process)

In each of the development parts 30NC, 30NM, and 30NY, there are cases where unnecessary luminescent toner NT remains on the surface of the photosensitive drum 31. This unnecessary luminescent toner NT is, for example, part of the luminescent toner NT used in the primary transfer process, such as the luminescent toner NT that was not transferred to the intermediate transfer belt 41 but remained on the surface of the photosensitive drum 31.

Then, in each of the development parts 30NC, 30NM, and 30NY, because the photosensitive drum 31 rotates in a state of being in press-contact with the cleaning blade 36, the luminescent toner NT remaining on the surface of the photosensitive drum 31 is scraped off by the cleaning blade 36. Thereby, the unnecessary luminescent toner NT is removed from the surface of the photosensitive drum 31.

Also, in the transfer part 40, there are cases where part of the luminescent toner NT that migrated to the surface of the intermediate transfer belt 41 in the primary transfer process does not migrate to the surface of the medium M in the secondary transfer process but remains on the surface of the intermediate transfer belt 41.

Then, in the transfer part 40, when the intermediate transfer belt 41 moves in the direction of the arrow F5, the luminescent toner NT remaining on the surface of the intermediate transfer belt 41 is scraped off by the cleaning blade 47. Thereby, the unnecessary luminescent toner NT is removed from the surface of the intermediate transfer belt 41.

Thereby, the image forming operation of the image forming apparatus in the case where the normal mode is selected by the user is complete.

[Selection of Light Resistance UP Modes 1 or 2]

On the other hand, in the case where the user has selected the light resistance UP mode (S101Y), the user selects whether to use the light resistance UP mode 1 by further operating the operation panel for example (S103).

Here, for example, the user can select either one of two stages of the light resistance UP mode (light resistance UP mode 1 or 2). The light resistance UP mode 1 is an image forming mode where a light resistance property superior to that in the normal mode can be obtained, and the light resistance UP mode 2 is an image forming mode where a light resistance property superior to that in the light resistance UP mode 1 can be obtained.

[Image Formation of Light Resistance UP Mode 1]

In the case where the user has selected the light resistance UP mode 1 (S103Y), the image forming apparatus forms an image by performing the image forming operation of the light resistance UP mode 1 based on image data D (S104 and S102).

Specifically, first, using non-luminescent toner T (the fluorescent cyan toner) and luminescent toner NT (the magenta toner and the yellow toner), the image forming apparatus performs the image forming processes (the development process, the primary transfer process, the secondary transfer process, and the fusing process) based on the image data D.

The contents of the development process, the primary transfer process, the secondary transfer process, and the fusing process using the non-luminescent toner T explained here are respectively the same as the contents of the development process, the primary transfer process, the secondary transfer process, and the fusing process using the luminescent toner NT mentioned above except for using the non-luminescent toner T instead of the luminescent toner NT. In this development process using the non-luminescent toner T, an electrostatic latent image that is a first latent image is formed on the surface of the photosensitive drum 31, and the non-luminescent toner T is let adhere to the electrostatic latent image.

Of course, the image forming apparatus can perform the cleaning process as necessary. The content of the cleaning process using the non-luminescent toner T is the same as the content of the cleaning process using the luminescent toner NT mentioned above except for using the non-luminescent toner T instead of the luminescent toner NT.

Thereby, as shown in FIG. 5, because the non-luminescent toner T and the luminescent toner NT adhere to specific regions of the surface of the medium M so as to become a specific pattern according to the image data D, a non-luminescent image G is formed (S104). This non-luminescent image G is formed based on the non-luminescent toner T adhering to the electrostatic latent image by the above-mentioned development process.

The coverage rate of the non-luminescent image G can be arbitrarily set, for example, according to the supply amounts of the non-luminescent toner T and the luminescent toner NT to the surface of the medium M, more specifically the adhesion amounts of the non-luminescent toner T and the luminescent toner NT to the surface of the photosensitive drum 31 (electrostatic latent image), or the like. Here, for example, the coverage rate of the non-luminescent image G in the light resistance UP mode 1 is 30%. In the embodiment, a coverage rate of a non-luminescent toner image is the same as that with respect to a luminescent toner image. In the invention, the coverage rate of one type of toners may be determined as an absolute value, or may be determined a relative value with respect to the other type of toners.

Subsequently, using the luminescent toner NT (the fluorescent cyan toner, the fluorescent magenta toner, and the fluorescent yellow toner), the image forming apparatus performs the image forming processes (the development process, the primary transfer process, the secondary transfer process, and the fusing process) based on the image data D again.

That is, the image data D used for the image forming apparatus to perform the image forming processes using the luminescent toner NT are the same as the image data D used for the image forming apparatus to perform the image forming processes using the non-luminescent toner T earlier.

The contents of the development process, the primary transfer process, the secondary transfer process, and the fusing process using the luminescent toner NT in the light resistance UP mode 1 are respectively the same as the contents of the development process, the primary transfer process, the secondary transfer process, and the fusing process using the luminescent toner NT in the normal mode mentioned above. In this development process using the luminescent toner NT, an electrostatic latent image that is a second latent image is formed on the surface of the photosensitive drum 31, and also the luminescent toner NT is let adhere to the electrostatic latent image.

Of course, the image forming apparatus can performing the cleaning process as necessity. The content of the cleaning process using the luminescent toner NT in the light resistance UP mode 1 is the same as the content of the cleaning process using the luminescent toner NT in the normal mode mentioned above.

Thereby, as shown in FIG. 5, because the luminescent toner NT is fused to specific regions of the surface of the medium M so as to become a specific pattern according to the image data D, a luminescent image NG is formed (S102). This luminescent-image NG is formed based on the luminescent toner NT let adhere to the electrostatic latent image by the development process mentioned above. Therefore, an image containing the non-luminescent image G and the luminescent image NG is formed.

In this case, the common image data D are used for forming both the non-luminescent image G and the luminescent image NG. Thereby, on the surface of the medium M, because the luminescent toner NT is fused in the same regions as the regions where the non-luminescent toner T was already fused, the luminescent image NG is formed so as to be nearly superimposed on the non-luminescent image G.

Also, in order to form the non-luminescent image G and the luminescent image NG, the fuser part 50 fuses the non-luminescent toner T and the luminescent toner NT to the medium M in separate processes for example. That is, for example, after fusing the non-luminescent toner T to the medium M in the earlier fusing process, the fuser part 50 fuses the luminescent toner NT to the medium M in the later fusing process.

The coverage rate of the luminescent image NG can be arbitrarily set, for example, according to the supply amount of the luminescent toner NT to the surface of the medium M, more specifically the adhesion amount of the luminescent toner NT to the surface of the photosensitive drum 31 (electrostatic latent image), or the like. Here, for example, the coverage rate of the luminescent image NG in the light resistance UP mode 1 is 100%.

Note that in order to form the non-luminescent image G and the luminescent image NG on one side of the medium M, the medium M that passed through the fuser part 50 is carried in the directions of the arrows F3 and F4 by the carrying rollers 65-67 along the carrying routes R3 and R5, and afterwards carried again in the direction of the arrow F1 by the carrying rollers 61 and 62 along the carrying route R1. In this case, the direction in which the medium M is carried is controlled by the carrying route switching guides 71 and 72. Thereby, it becomes possible to form the luminescent image NG on the non-luminescent image G after forming the non-luminescent image G on the surface of the medium M.

Thereby, the image forming operation of the image forming apparatus in the case where the light resistance UP mode 1 is selected by the user is complete

[Image Formation of Light Resistance UP Mode 2]

On the other hand, in the case where the user has not selected the light resistance UP mode 1 (S103N), the image forming apparatus forms an image by performing the image forming operation of the light resistance UP mode 2 based on the image data D (S105 and S102).

Specifically, first, as shown in FIG. 5, the image forming apparatus forms a non-luminescent image G based on the image data D by performing the same operation as in the formation operation of the non-luminescent image G in the light resistance UP mode 1 except for the fact that the coverage rate is different (S105).

Although the coverage rate of the non-luminescent image G in the light resistance UP mode 2 is not particularly limited as far as it is higher than the coverage rate of the non-luminescent image G in the light resistance UP mode 1, for example, it is 50%.

Subsequently, as shown in FIG. 5, the image forming apparatus forms a luminescent image NG on the non-luminescent image G based on the image data D by performing the same operation as the formation operation of the luminescent image NG in the light resistance UP mode 1 (S102). That is, the image data D used for the image forming apparatus to perform the image forming processes using the luminescent toner NT are the same as the image data D used earlier for the image forming apparatus to perform the image forming processes using the non-luminescent toner T. Therefore, an image including the non-luminescent image G and the luminescent image NG is formed.

In this case also, by the common image data D being used for forming the non-luminescent image G and the luminescent image NG, the luminescent image NG is formed so as to be nearly superimposed on the non-luminescent image G.

Although the coverage rate of the luminescent image NG in the light resistance UP mode 2 is not particularly limited in the same manner as the coverage rate of the luminescent image NG in the light resistance UP mode 1, for example, it is 100%.

Note that in order to form the non-luminescent image G and the luminescent image NG on one side of the medium M, the medium M that passed through the fuser part 50 is carried in the directions of arrows F3 and F4 by the carrying rollers 65-67 along the carrying routes R3 and R5, and afterwards carried again in the direction of the arrow F1 by the carrying rollers 61 and 62 along the carrying route R1 following the same procedure as the carrying procedure of the medium M in the light resistance UP mode 1.

Thereby, the image forming operation of the image forming apparatus in the case where the light resistance UP mode 2 is selected by the user is complete.

1-6. Actions and Effects

In this image forming apparatus, non-luminescent toner T is let adhere to an electrostatic latent image formed based on image data D, luminescent toner NT is let adhere to an electrostatic latent image formed based on the image data D, and afterwards those non-luminescent toner T and luminescent toner NT are transferred and fused to a medium M. Therefore, for the reason explained below, a high-quality image can be obtained.

As shown in FIG. 4, in order to form an image on the surface of the medium M, if only a luminescent image NG is formed using the luminescent toner NT, the user can obtain a desired image having luminescence.

However, as mentioned above, although the luminescent toner NT can achieve an excellent texture utilizing its luminescence, it essentially has a nature of being easy to discolor. Accompanying this, if an image is formed of only the luminescent image NG, because contours become indistinct as the color density declines due to discoloration of the luminescent toner NT, the image quality becomes easy to deteriorate. Thereby, after the discoloration of the luminescent toner NT, not only is its luminescence simply lost, but it also becomes difficult to recognize what the content of the image formed on the surface of the medium M originally was.

Therefore, from the viewpoint of maintaining the image content, it is difficult to obtain a high-quality image.

As opposed to this, as shown in FIG. 5, in order to form an image on the surface of the medium M, if a non-luminescent image G is formed using the non-luminescent toner T, and also a luminescent image NG is formed using the luminescent toner NT so as to be superimposed on the non-luminescent image G, the user can obtain a desired image having luminescence.

Regarding yellow toner and magenta toner, preferred color differences were obtained. Tables A1 and A2 show visual observations with respect to color differences (⊿E) in conditions where a luminescent toner is mixed with a non-luminescent toner of various duties, which is 0% to 100%. Each of the conditions were observed and judged by a tester. Table A1 is for yellow toner. Table A2 is for magenta toner. The color differences (color system chromaticity) are calculated with an equation below:

$$\Delta E=(\Delta L^2+\Delta a^2+\Delta b^2)^{1/2}$$

TABLE A1

| Yellow Tonner | | | |
|---|---|---|---|
| Duty (%) | | | Visual |
| Y | NY | ⊿E | Observation |
| 0 | 100 | — | — |
| 10 | 100 | 8.6 | Good |
| 20 | 100 | 13.9 | Good |
| 30 | 100 | 18.4 | Good |
| 40 | 100 | 22.3 | Fine |
| 50 | 100 | 26.3 | Fine |
| 60 | 100 | 29.9 | Poor |
| 70 | 100 | 34.3 | Poor |
| 80 | 100 | 37.6 | Poor |
| 90 | 100 | 41.3 | Poor |
| 100 | 100 | 45.7 | Poor |

Y: Non Luminescent Yellow Toner
NT: Luminescent Yellow Toner

TABLE A2

| Magenta Tonner | | | |
|---|---|---|---|
| Duty (%) | | | Visual |
| M | NM | ⊿E | Observation |
| 0 | 100 | — | — |
| 10 | 100 | 2.0 | Good |
| 20 | 100 | 4.5 | Good |
| 30 | 100 | 5.4 | Good |
| 40 | 100 | 6.8 | Fine |
| 50 | 100 | 8.3 | Fine |

TABLE A2-continued

| Magenta Tonner | | | |
|---|---|---|---|
| Duty (%) | | | Visual |
| M | NM | ⊿E | Observation |
| 60 | 100 | 9.0 | Poor |
| 70 | 100 | 10.3 | Poor |
| 80 | 100 | 11.0 | Poor |
| 90 | 100 | 12.9 | Poor |
| 100 | 100 | 15.3 | Poor |

M: Non Luminescent Magenta Toner
NM: Luminescent Magenta Toner

Based on Table A1, the color difference (⊿E) of yellow toner is to be 26.3 or below, and preferably 18.4 or below in order to adequately exercise the invention.

Based on Table A2, the color difference (⊿E) of magenta toner is to be 8.3 or below, and preferably 5.4 or below in order to adequately exercise the invention.

Moreover, as mentioned above, unlike the luminescent toner NT, the non-luminescent toner T essentially has a nature of being hard to discolor. Accompanying this, if the image is formed of a non-luminescent image G and a luminescent image NG, even if contours become indistinct as color density declines in the luminescent image NG due to the discoloration of the luminescent toner NT, because in the non-luminescent image G the color density is hard to decline and the contours are hard to become indistinct, the whole image quality becomes hard to deteriorate. Thereby, after the discoloration of the luminescent toner NT, even if its luminescence is lost, it becomes easy to recognize based on the non-luminescent image G what the content of the image formed on the surface of the medium M originally was.

Especially, because the non-luminescent toner T and the luminescent toner NT are fused to the medium M based on the common image data D, on the surface of the medium M, the region where the non-luminescent toner T is fused and the region where the luminescent toner NT is fused are nearly superimposed with each other. In this case, because a color shift due to the position shift between the non-luminescent toner T and the luminescent toner NT is sufficiently suppressed, deterioration in the image quality due to the color shift is suppressed.

Therefore, from the viewpoint of maintaining the image content, a high-quality image can be obtained.

Besides this, the following advantage can also be obtained in the above-mentioned image forming apparatus.

Firstly, in order to form the non-luminescent image G and the luminescent image NG, the fuser part 50 fuses the non-luminescent toner T and the luminescent toner NT to the medium M in separate processes. That is, the image forming apparatus forms the non-luminescent image G by performing the image forming processes (the development process, the primary transfer process, the secondary transfer process, and the fusing process) using the non-luminescent toner T, and afterwards forms the luminescent image NG by performing the image forming processes using the luminescent toner NT.

In this case, because the fusing process of the non-luminescent toner T is already complete before forming the luminescent image NG, the non-luminescent toner T has already strongly adhered to the medium M. Thereby, in comparison with the case where the fusing process of the non-luminescent toner T is not complete yet before forming the luminescent image NG, it becomes hard for the non-luminescent toner T to affect adversely the image quality.

To be in more detail, in the state where the fusing process of the non-luminescent toner T is not complete yet, because the non-luminescent toner T has not strongly adhered to the medium M, the non-luminescent toner T becomes easy to drop out from the medium M, and also the non-luminescent toner T becomes easy to move from its original fused position to another position on the medium M. Thereby, in the non-luminescent image G, it is possible for color density to decline and contours to become indistinct, and therefore the image quality becomes easy to deteriorate. As opposed to this, in the state where the fusing process of the non-luminescent toner T is already complete, because the non-luminescent toner T has strongly adhered to the medium M, the non-luminescent toner T becomes hard to drop out from the medium M, and also the non-luminescent toner T becomes hard to move from its original fused position to another position on the medium M. Thereby, in the non-luminescent image G, the color density becomes hard to decline, and also the contours become hard to become indistinct, making the image quality hard to deteriorate.

Therefore, if the fuser part 50 fuses the non-luminescent toner T and the luminescent toner NT to the medium M in separate processes, because the image quality further improves, higher effects can be obtained.

Secondly, if the luminescent toner contains one or both of a fluorescent coloring agent and a fluorescent whitening agent, utilizing the luminescence of the luminescent toner, a high-quality fluorescent image can be formed.

Thirdly, utilizing the fact that the fluorescent cyan toner essentially tends to be hard to discolor, if two kinds of the non-luminescent toner (the yellow toner and the magenta toner) and three kinds of the luminescent toner (the fluorescent yellow toner, the fluorescent magenta toner, and the fluorescent cyan toner) are used, because the cyan toner that is non-luminescent toner need not be used, the kinds of toner used for forming the image decreases. Therefore, because the development part 30 containing the cyan toner need not be used, the configuration of the image forming apparatus can be simplified, and also images can be easily formed.

2. Modifications

As explained below, the configuration of the image forming apparatus and the configuration of an image formed by the image forming apparatus can be modified as appropriate.

Modification 1

Specifically, as shown in FIG. 5, in order to form the luminescent image NG on the non-luminescent image G, the fuser part 50 fuses the non-luminescent toner T and the luminescent toner NT on the medium M in separate processes. In this case, after forming the non-luminescent image G by performing the image forming processes (the development process, the primary transfer process, the secondary transfer process, and the fusing process) using the non-luminescent toner T, the luminescent image NG is formed by performing the image forming processes using the luminescent toner NT.

However, for example, if the luminescent image NG can be formed on the non-luminescent image G, the fuser part 50 can also fuse the non-luminescent toner T and the luminescent toner NT to the medium M in the same process for example.

For example, the development process and the primary transfer process can be performed using the non-luminescent toner T, subsequently the development process and the primary transfer process can be performed using the luminescent toner NT, and afterwards the secondary transfer process and the fusing process can be performed using those non-luminescent toner T and luminescent toner NT. In this case, the non-luminescent toner T is transferred to the surface of the intermediate transfer belt 41, and afterwards the luminescent toner NT is transferred onto the non-luminescent toner T, therefore the non-luminescent toner T and the luminescent toner NT are superimposed with each other on the intermediate transfer belt 41. Thereby, the non-luminescent toner T and the luminescent toner NT are fused altogether in the same process by the fuser part 50.

Alternatively, for example, the development process, the primary transfer process, and the secondary transfer process can be performed using the non-luminescent toner T, subsequently the development process, the primary transfer process, and the secondary transfer process can be performed using the luminescent toner NT, and afterwards the fusing process can be performed using those non-luminescent toner T and luminescent toner NT. In this case, because the luminescent toner NT is transferred onto the non-luminescent toner T after the non-luminescent toner T is transferred to the surface of the medium M, the non-luminescent toner T and the luminescent toner NT are superimposed with each other on the medium M. Thereby, the non-luminescent toner T and the luminescent toner NT are fused together in the same process by the fuser part 50.

In these cases also, because the non-luminescent image G and the luminescent image NG are superimposed with each other by respectively forming the non-luminescent image G and the luminescent image NG based on the common image data D, the same effects can be obtained.

However, as mentioned above, because the non-luminescent toner T that is not fused to the medium M yet is easy to drop out or move, the image quality can deteriorate. Therefore, in order to improve the image quality, it is preferred that the fuser part 50 fuses the non-luminescent toner T and the luminescent toner NT to the medium M in separated processes.

[Modification 2]

As shown in FIG. 5, after forming the non-luminescent image G on the surface of the medium M using the non-luminescent toner T, the luminescent image NG is formed on the non-luminescent image G using the luminescent toner NT. In this case, the image forming apparatus performs an image forming operation (the development process, the primary transfer process, the secondary transfer process, and the fusing process) using the non-luminescent toner T based on image data D, and afterwards performs an image forming operation using the luminescent toner NT based on the image data D.

The operation procedure to form the luminescent image NG after forming the non-luminescent image G in this manner is used, for example, in applications where an image only needs to be simply formed on the surface of the medium M, or the like. In this case, as is evident from FIG. 5, the top layer of the image formed on the surface of the medium M becomes the luminescent image NG.

Figure 6:
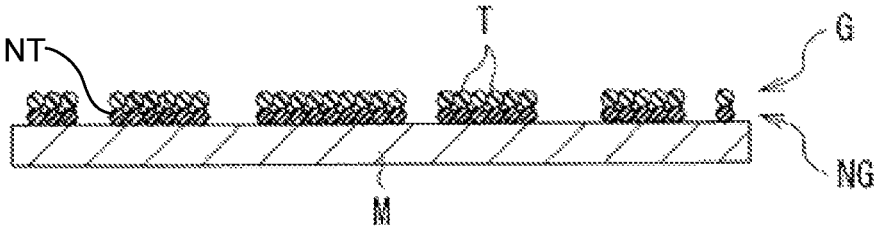
FIG. 6 is a cross-sectional view for explaining the configuration of yet another image formed by the image forming apparatus of an embodiment of this invention.

However, for example, as shown in FIG. 6 that corresponds to FIG. 5, after forming the luminescent image NG on the surface of the medium M using the luminescent toner NT, the non-luminescent image G can be formed on the luminescent image NG using the non-luminescent toner T. In this case, the image forming apparatus performs an image forming operation using the luminescent toner NT based on image data D, and afterwards performs an image forming operation using the non-luminescent toner T based on the image data D.

The operation procedure to form the non-luminescent image G after forming the luminescent image NG in this manner is used, for example, in such applications that form an image on the surface of the medium M and afterwards transfer the image to another medium. Although the other medium is not particularly limited, for example, it is a T shirt used in the T-shirt printing application mentioned above, or the like. In this case, as is evident from FIG. 6, the top layer of the image formed on the surface of the medium M becomes the non-luminescent image G. However, the top layer of the image transferred to the other medium becomes the luminescent image NG.

In this case also, by respectively forming the non-luminescent image G and the luminescent mage NG based on the common image data D, the same effects can be obtained.

[Modification 3]

Although the cyan toner was not used by using the yellow toner and the magenta toner as the non-luminescent toner NT, for example, the can toner can be used. In this case, the non-luminescent image G is formed using three kinds of the non-luminescent toner (the yellow toner, the magenta toner, and the cyan toner). In this case also, by forming the non-luminescent image G and the luminescent image NG based on the common image data D, the same effects can be obtained.

However, as mentioned above, in order to decrease the kinds of toner used for forming the image, it is preferred to use only the yellow toner and the magenta toner as the non-luminescent toner NT.

[Modification 4]

Although the transfer process using the non-luminescent toner T and the transfer process using the luminescent toner NT were performed using one transfer part 40, for example, two transfer parts 40 can be used. That is, the image forming apparatus can be provided with a first transfer part 40 to perform the transfer process using the non-luminescent toner T and a second transfer part 40 to perform the transfer process using the luminescent toner NT. In this case also, the same effects can be obtained. However, in order to simplify the configuration of the image forming apparatus, using one transfer part 40 is preferred.

In the same manner, although the fusing process using the non-luminescent toner T and the fusing process using the luminescent toner NT were performed using one fuser part 50, two fuser parts 50 can be used. That is, the image forming apparatus can be provided with a first fuser part 50 to perform the fusing process using the non-luminescent toner T and a second fuser part 50 to perform the fusing process using the luminescent toner NT. In this case also, the same effects can be obtained. However, in order to simplify the configuration of the image forming apparatus, using one fuser part 50 is preferred.

[Modification 5]

The respective configurations of the non-luminescent image G and the luminescent image NG can be arbitrarily set. For example, the respective thicknesses of the non-luminescent image G and the luminescent image NG are not particularly limited. Specifically, for example, if increasing the luminescence of the image is desired, the thickness of the luminescent image NG can be set greater than the thickness of the non-luminescent image G. Also, for example, in order to make it easy to recognize the original content of the image formed on the surface of the medium M based on the non-luminescent image G even when a long period of time has passed after forming the image, the thickness of the non-luminescent image G can be set greater than the thickness of the luminescent image NG. In these cases also, the same effects can be obtained.

Embodiment

An embodiment of this invention is explained in detail. Note that the order of the planation is as follows. 1. Essential Quality of Image. 2. Image quality improvement.

<1. Essential Quality of Image>

First, in order to examine the actual performance of the quality of each color concerning an image (luminescent image) formed using luminescent toner (the luminescent yellow toner, the luminescent magenta toner, or the luminescent cyan toner), after forming an image of each color using the luminescent toner, the image quality of each color was examined.

In forming each image, a color printer MICROLINE VINCI C941dn (with the linear speed at the outermost circumference of the photosensitive drum=200 mm/sec) manufactured by Oki Data Corporation was used as the image forming apparatus, and also a color printer sheet Excellent White A4 manufactured by Oki Data Corporation was used as the medium on which the image was formed.

In this case, as the image forming mode, the normal mode explained referring to FIG. 3 was used. Thereby, solid images of each color (coverage rate=100%) were formed by performing the image forming processes (the development process, the primary transfer process, the secondary transfer process, and the fusing process) using each one of the fluorescent yellow toner, the fluorescent magenta toner, and the fluorescent cyan toner. The environmental condition was set to the normal temperature condition (temperature=25° C., and humidity=40%), and the print direction of the image was set to the longitudinal direction of the medium. Note that the area density in fusing each of the fluorescent yellow toner, the fluorescent magenta toner, and the fluorescent cyan toner was set to 0.4 mg/cm$^2$.

In examining the image quality, a survival rate (%) was obtained based on the images of each color, and changes with time in the quality of the images of each color were visually evaluated.

In obtaining the survival rate of the images formed using the fluorescent yellow toner, first, five images (luminescent images) were formed using the fluorescent yellow toner. Subsequently, the densities of the five images were measured using a densitometer (528 spectrodensitometer manufactured by X-Rite, Inc.), and the average of those measured values was computed. In this case, the position to measure the density was set to the central position of each image. Subsequently, while the five images were irradiated with test light (illuminance=55000 lux, and irradiation time=30 hours) using a weatherometer (xenon weatherometer Model Ci4000 manufactured by ATLAS Co.), their densities were measured at every 3 hours. In this case, in the same manner as in the case where the densities were measured before the test light irradiation, the average value of the density values of the five images measured at every 3 hours was computed. Lastly, the survival rates were computed at every 3 hours based on a formula: Survival rate (%)=(Density after test light irradiation/Density before test light irradiation)×100.

The survival rates of each of the images formed using the fluorescent magenta toner and the images formed using the fluorescent cyan toner were also obtained following the same procedure as the computation procedure of the survival rate of the images formed using the fluorescent yellow toner. As a result, the results listed in Tables 1-3 were obtained. Upper laws in the tables means hours that passed from the beginning, which is named as "Passing Time."

TABLE 1

| TONER: Fluorescent Yellow Toner, MODE: Normal, COVERAGE RATE: 100% | | | | | | | | | | | |
|---|---|---|---|---|---|---|---|---|---|---|---|
| Passing Time (hour) | 0 | 3 | 6 | 9 | 12 | 15 | 18 | 21 | 24 | 27 | 30 |
| Survival Rate (%) | 100 | 91.1 | 82.6 | 71.2 | 65.5 | 61.6 | 55.8 | 53.6 | 51.2 | 47.5 | 44.5 |

TABLE 2

| TONER: Fluorescent Magenta Toner, MODE: Normal, COVERAGE RATE: 100% | | | | | | | | | | | |
|---|---|---|---|---|---|---|---|---|---|---|---|
| Passing Time (hour) | 0 | 3 | 6 | 9 | 12 | 15 | 18 | 21 | 24 | 27 | 30 |
| Survival Rate (%) | 100 | 91.1 | 82.6 | 72.9 | 67.6 | 64 | 58.8 | 57.8 | 55 | 52.5 | 50.8 |

TABLE 3

| TONER: Fluorescent Cyan Toner, MODE: Normal, COVERAGE RATE: 100% | | | | | | | | | | | |
|---|---|---|---|---|---|---|---|---|---|---|---|
| | Passing Time (hour) | | | | | | | | | | |
| | 0 | 3 | 6 | 9 | 12 | 15 | 18 | 21 | 24 | 27 | 30 |
| Survival Rate (%) | 100 | 99.9 | 100 | 98.9 | 98.8 | 99.9 | 98 | 100 | 100 | 100 | 100 |

In visually evaluating the changes with time in the quality of the images (luminescent images) formed using the fluorescent yellow toner, while irradiating each image with the test light, the image quality was visually evaluated at every 3 hours. In the same manner, for each of the images formed using the fluorescent magenta toner and the images formed using the fluorescent cyan toner also, the image quality was visually evaluated while irradiating the image with the test light. As a result, the results listed in Table 4 were obtained.

In this case, evaluated as "A" is the case where hue of the image is still easy to recognize because the hue when the image was initially formed is sufficiently retained. Evaluated as "C" is the case where hue of the image is hard to recognize because the hue when the image was initially formed faded.

As listed in Tables 1-3, when images were formed using only luminescent toner, great differences occurred in light resistance according to the kind (color) of the luminescent toner.

Specifically, when the fluorescent cyan toner was used (Table 3), because the image discolored little even when time has passed, the survival rate was nearly 100% even when 30 hours have passed. This result indicates that the fluorescent cyan toner is essentially hard to discolor.

As opposed to this, when the fluorescent yellow toner or the fluorescent magenta toner was used (Tables 1 and 2), because the images greatly discolored as time passed, when 30 hours have passed, the survival rate decreased to about a half. In this case, especially, the survival rate decreased more when the fluorescent yellow toner was used than when the fluorescent magenta toner was used. This result indicates that the fluorescent yellow toner and the fluorescent magenta toner are essentially easy to discolor.

TABLE 4

MODE: Normal, COVERAGE RATE: 100%

| | Quality Evaluation | | |
|---|---|---|---|
| Passing Time (hour) | Fluorescent Yellow | Fluorescent Magenta | Fluorescent Cyan |
| 0 | A | A | A |
| 3 | A | A | A |
| 6 | A | A | A |
| 9 | A | A | A |
| 12 | C | C | A |
| 15 | C | C | A |
| 18 | C | C | A |
| 21 | C | C | A |
| 24 | C | C | A |
| 27 | C | C | A |
| 30 | C | C | A |

Also, as listed in Table 4, when images were formed using only luminescent toner, great differences occurred in image quality according to the kind (color) of the luminescent toner.

Specifically, when the fluorescent cyan toner was used, because the hue was sufficiently retained even when time has passed, a good image quality was obtained even when 30 hours have passed.

As opposed to this, when the fluorescent yellow toner or the fluorescent magenta toner was used, because the hue rapidly deteriorated as time passed, when 9 hours have passed, no good image quality was obtained.

Based on these, when an image is formed using the fluorescent cyan toner, the tendency is that even when time has passed, the image is hard to discolor, and the image quality is sufficiently retained. As opposed to this, when an image is formed using the fluorescent yellow toner or the fluorescent magenta toner, the tendency is that as time passes, the image is easy to discolor, and the image quality is easy to decline.

<2. Image Quality Improvement>

Next, in order to examine the improvement situation on image quality, after forming an image (a non-luminescent image or a luminescent image) using non-luminescent toner or luminescent toner, light resistance and quality of the image were examined.

Here, as mentioned above, considering the fact that sufficient light resistance was obtained when the fluorescent cyan toner was used and that no sufficient light resistance was obtained when the fluorescent yellow toner or the fluorescent magenta toner was used, the fluorescent yellow toner and the fluorescent magenta toner were used as the luminescent toner.

In forming an image using the fluorescent yellow toner or the fluorescent magenta toner, as the image forming mode, two kinds of modes (the normal mode and the light resistance UP mode) explained referring to FIG. 3 were used.

In forming a normal mode image, following the above-mentioned image forming procedure, a solid image (coverage rate=100%) was formed using either one of the fluorescent yellow toner or the fluorescent magenta toner.

The procedure in forming a light resistance UP mode image is as follows. After a solid image was formed using non-luminescent toner (the yellow toner or the magenta toner), a solid image was formed using luminescent toner of the similar color (the fluorescent yellow toner or the fluorescent magenta toner). In this case, as listed in Tables 5 and 6, the coverage rate (%) of the non-luminescent image was varied within a range of 10-100%, and the coverage rate of the luminescent image was set to 100%. Note that details on the model number of the image forming apparatus, the kind of medium, environmental conditions, etc. are as mentioned above.

Here, before examining the improvement situation on the image quality, first, after examining the hue of each of the normal mode image and the light resistance UP mode image, the hue of the light resistance UP mode image was evaluated. As a result, the results listed in Tables 5 and 6 were obtained.

In examining the hue of the of the normal mode image, after forming a normal mode image (luminescent image) using the fluorescent yellow toner or the fluorescent magenta toner, the L value (L*), the a value (a*), and the b value (b*) of the image were measured using a densitometer (528 spectrodensitometer manufactured by X-Rite, Inc.). In examining the hue of the light resistance UP mode image, after forming light resistance UP mode images (non-luminescent image and luminescent image) using the fluorescent yellow toner and the yellow toner and also forming light resistance UP mode images (non-luminescent image and luminescent image) using the fluorescent magenta toner and the magenta toner, the L value (L*), the a value (a*), and the b value (b*) of the images were measured using the above-mentioned densitometer.

In evaluating the hue of the light resistance UP mode image (the fluorescent yellow toner), compared with the hue (the L value, the a value, and the b value) of the luminescent image of the normal mode, the case where the L-value variation amount was less than 2.62%, the a-value variation amount was less than 18.76%, and the b-value variation amount was less than 30.11% was evaluated as "A". The case where the L-value variation amount was 2.62% or more and less than 3.15%, the a-value variation amount was 18.76% or more and less than 21.90%, and the b-value variation amount was 30.11% or more and less than 33.63% was evaluated as "B". The case where the L-value variation amount was 3.15% or more, the a-value variation amount was 21.90% or more, and the b-value variation amount was 33.63% or more was evaluated as "C".

In evaluating the hue of the light resistance UP mode image (the fluorescent magenta toner), compared with the hue (the L value, the a value, and the b value) of the luminescent image of the normal mode, the case where the L-value variation amount was less than 9.85%, the a-value variation amount was less than 12.15%, and the b-value variation amount was less than 4.65% was evaluated as "A". The case where the L-value variation amount was 9.85% or more and less than 11.63%, the a-value variation amount was 12.15% or more and less than 15.93%, and the b-value variation amount was 4.65% or more and less than 5.86% was evaluated as "B". The case where the L-value variation amount was 11.63% or more, the a-value variation amount was 15.93% or more, and the b-value variation amount was 5.86% or more was evaluated as "C".

TABLE 5

TONER: (Fluorescent Yellow Toner) or (Fluorescent Yellow Toner + Yellow Toner)

| Mode | Coverage Rate (%) Non-Luminescent Image | Coverage Rate (%) Luminescent Image | L* | a* | b* | Quality Evaluation |
|---|---|---|---|---|---|---|
| Normal | — | 100 | 95.8 | −22.6 | 50.6 | — |
| Resistance UP | 10 | 100 | 95.1 | −21.3 | 59 | A |
| Resistance UP | 20 | 100 | 94.3 | −20.3 | 64.2 | A |
| Resistance UP | 30 | 100 | 93.8 | −19.4 | 68.6 | A |
| Resistance UP | 40 | 100 | 93.3 | −18.4 | 72.3 | B |
| Resistance UP | 50 | 100 | 92.8 | −17.7 | 76.2 | B |
| Resistance UP | 60 | 100 | 92.1 | −16.7 | 79.6 | C |
| Resistance UP | 70 | 100 | 91.9 | −15.8 | 84 | C |
| Resistance UP | 80 | 100 | 91.6 | −15.2 | 87.1 | C |
| Resistance UP | 90 | 100 | 91.1 | −14.4 | 90.8 | C |
| Resistance UP | 100 | 100 | 90.6 | −13.3 | 95 | C |

TABLE 6

TONER: (Fluorescent Magenta Toner) or (Fluorescent Magenta Toner + Magenta Toner)

| Mode | Coverage Rate (%) Non-Luminescent Image | Coverage Rate (%) Luminescent Image | L* | a* | b* | Quality Evaluation |
|---|---|---|---|---|---|---|
| Normal | — | 100 | 55.6 | −25.4 | −51.7 | — |
| Resistance UP | 10 | 100 | 53.9 | −24.9 | −52.7 | A |
| Resistance UP | 20 | 100 | 52.1 | −23.7 | −54.1 | A |
| Resistance UP | 30 | 100 | 51.2 | −23.1 | −53.8 | A |
| Resistance UP | 40 | 100 | 50.1 | −22.3 | −54.3 | B |
| Resistance UP | 50 | 100 | 49.1 | −21.3 | −55 | B |
| Resistance UP | 60 | 100 | 48.2 | −21.1 | −54.7 | C |
| Resistance UP | 70 | 100 | 47.4 | −20.2 | −55.5 | C |
| Resistance UP | 80 | 100 | 46.7 | −19.9 | −55.5 | C |
| Resistance UP | 90 | 100 | 45.3 | −18.5 | −55.4 | C |
| Resistance UP | 100 | 100 | 43.6 | −16.7 | −55.6 | C |

As listed in Table 56, also in the case where the light resistance UP mode images were formed using the fluorescent yellow toner and the yellow toner, the hue of the images varied according to the coverage rates of the non-luminescent images formed using the yellow toner.

Specifically, when the coverage rate of the non-luminescent image was 50% or lower, the hue of the light resistance UP mode image became close to the hue of the normal mode image, and when the coverage rate of the non-luminescent image was 30% or lower, the hue of the light resistance UP mode became closer to the hue of the normal mode image. That is, when the coverage rage of the non-luminescent image was 50% or lower, nearly equivalent hue to the hue of the normal mode image was obtained in the light resistance UP mode image.

In addition, as listed in Table 6, also in the case where the light resistance UP mode images were formed using the fluorescent magenta toner and the magenta toner, the same result as in the case where the light resistance UP mode images were formed using the fluorescent yellow toner and the yellow toner (Table 5) was obtained.

Specifically, when the coverage rate of the non-luminescent image was 50% or lower, preferably when the coverage rate was 30% or lower, the hue of the light resistance UP mode image became close to the hue of the normal mode image Next, in order to examine the improvement situation on the quality of the light resistance UP mode images, the survival rates were obtained, and the changes with time in the image quality were also visually evaluated. The procedure to compute the survival rates and the procedure to evaluate the image quality are as mentioned above.

In this case, when the survival rates (%) were obtained based on normal mode images formed using the fluorescent yellow toner, the results listed in Table 7 were obtained, and when the changes with time in the image quality of the normal mode images were visually evaluated, the results listed in Table 10 were obtained. Also, when the survival rates (%) were obtained based on light resistance UP mode images formed using the fluorescent yellow toner and the yellow toner, the results listed in Tables 8 and 9 were obtained, and when the changes with time in the image quality of the light resistance UP mode images were visually evaluated, the results listed in Tables 11 and 12 were obtained.

When the survival rates (%) were obtained based on normal mode images formed using the fluorescent magenta toner, the results listed in Table 13 were obtained, and when the changes with time in the image quality of the normal mode images were visually evaluated, the results listed in Table 16 were obtained. Also, when the survival rates (%) were obtained based on light resistance UP mode images formed using the fluorescent magenta toner and the magenta toner, the results listed in Tables 14 and 15 were obtained, and when the changes with time in the image quality of the light resistance UP mode images were visually evaluated, the results listed in Tables 17 and 18 were obtained.

Note that in forming the light resistance UP mode images, considering the results listed in Tables 5 and 6, the coverage rates of the non-luminescent images were set to 30% or 50%. The light resistance UP mode where the coverage rate of the non-luminescent image is 30% corresponds to the light resistance UP mode 1 explained referring to FIG. 3. The light resistance UP mode where the coverage rate of the non-luminescent image is 50% corresponds to the light resistance UP mode 2 explained referring to FIG. 3.

TABLE 7

| TONER: Fluorescent Yellow Toner, MODE: Normal, COVERAGE RATE: 100% | | | | | | | | | | | |
|---|---|---|---|---|---|---|---|---|---|---|---|
| | Passing Time (hour) | | | | | | | | | | |
| | 0 | 3 | 6 | 9 | 12 | 15 | 18 | 21 | 24 | 27 | 30 |
| Survival Rate (%) | 100 | 91.3 | 82.6 | 76.4 | 70.2 | 65.6 | 60.9 | 56.7 | 52.6 | 49.4 | 46.2 |

TABLE 8

| TONER: (Fluorescent Yellow Toner + Yellow Toner), MODE: Resistance UP 1. COVERAGE RATE (Non-Fluorescent Image): 30%. COVERAGE RATE (Fluorescent Image): 100%. | | | | | | | | | | | |
|---|---|---|---|---|---|---|---|---|---|---|---|
| | Passing Time (hour) | | | | | | | | | | |
| | 0 | 3 | 6 | 9 | 12 | 15 | 18 | 21 | 24 | 27 | 30 |
| Survival Rate (%) | 100 | 94.8 | 89.7 | 86 | 82.4 | 79.8 | 77.2 | 74.9 | 72.6 | 70.6 | 68.7 |

TABLE 9

| TONER: (Fluorescent Yellow Toner + Yellow Toner), MODE: Resistance UP 2. COVERAGE RATE (Non-Fluorescent Image): 50%. COVERAGE RATE (Fluorescent Image): 100%. | | | | | | | | | | | |
|---|---|---|---|---|---|---|---|---|---|---|---|
| | Passing Time (hour) | | | | | | | | | | |
| | 0 | 3 | 6 | 9 | 12 | 15 | 18 | 21 | 24 | 27 | 30 |
| Survival Rate (%) | 100 | 96.1 | 92.2 | 89.4 | 86.6 | 84.5 | 82.5 | 80.8 | 79 | 77.9 | 76.7 |

TABLE 10

| TONER: Fluorescent Yellow Toner, MODE: Normal, COVERAGE RATE: 100% | | | | | | | | | | | |
|---|---|---|---|---|---|---|---|---|---|---|---|
| | Passing Time (hour) | | | | | | | | | | |
| | 0 | 3 | 6 | 9 | 12 | 15 | 18 | 21 | 24 | 27 | 30 |
| Evaluation | A | A | A | A | C | C | C | C | C | C | C |

TABLE 11

| TONER: (Fluorescent Yellow Toner + Yellow Toner), MODE: Resistance UP 1. COVERAGE RATE (Non-Fluorescent Image): 30%. COVERAGE RATE (Fluorescent Image): 100%. | | | | | | | | | | | |
|---|---|---|---|---|---|---|---|---|---|---|---|
| | Passing Time (hour) | | | | | | | | | | |
| | 0 | 3 | 6 | 9 | 12 | 15 | 18 | 21 | 24 | 27 | 30 |
| Evaluation | A | A | A | A | A | A | A | A | A | C | C |

TABLE 12

| TONER: (Fluorescent Yellow Toner + Yellow Toner), MODE: Resistance UP 2. COVERAGE RATE (Non-Fluorescent Image): 50%. COVERAGE RATE (Fluorescent Image): 100%. | | | | | | | | | | | |
|---|---|---|---|---|---|---|---|---|---|---|---|
| | Passing Time (hour) | | | | | | | | | | |
| | 0 | 3 | 6 | 9 | 12 | 15 | 18 | 21 | 24 | 27 | 30 |
| Evaluation | A | A | A | A | A | A | A | A | A | A | A |

TABLE 13

| TONER: Fluorescent Magenta Toner, MODE: Normal, COVERAGE RATE: 100% | | | | | | | | | | | |
|---|---|---|---|---|---|---|---|---|---|---|---|
| | Passing Time (hour) | | | | | | | | | | |
| | 0 | 3 | 6 | 9 | 12 | 15 | 18 | 21 | 24 | 27 | 30 |
| Survival Rate (%) | 100 | 92.9 | 85.7 | 78.8 | 71.9 | 67.4 | 62.9 | 59.2 | 55.5 | 52.7 | 50 |

TABLE 14

| TONER: (Fluorescent Magenta Toner + Magenta Toner), MODE: Resistance UP 1. COVERAGE RATE (Non-Fluorescent Image): 30%. COVERAGE RATE (Fluorescent Image): 100%. | | | | | | | | | | | |
|---|---|---|---|---|---|---|---|---|---|---|---|
| | Passing Time (hour) | | | | | | | | | | |
| | 0 | 3 | 6 | 9 | 12 | 15 | 18 | 21 | 24 | 27 | 30 |
| Survival Rate (%) | 100 | 94.9 | 89.9 | 85.1 | 80.4 | 76.7 | 73 | 70.1 | 67.2 | 65 | 62.8 |

TABLE 15

| TONER: (Fluorescent Magenta Toner + Magenta Toner), MODE: Resistance UP 2. COVERAGE RATE (Non-Fluorescent Image): 50%. COVERAGE RATE (Fluorescent Image): 100%. | | | | | | | | | | | |
|---|---|---|---|---|---|---|---|---|---|---|---|
| | Passing Time (hour) | | | | | | | | | | |
| | 0 | 3 | 6 | 9 | 12 | 15 | 18 | 21 | 24 | 27 | 30 |
| Survival Rate (%) | 100 | 96.2 | 92.5 | 88.8 | 85.1 | 82 | 79 | 76.4 | 73.8 | 71.9 | 70.1 |

TABLE 16

| TONER: Fluorescent Magenta Toner, MODE: Normal, COVERAGE RATE: 100% | | | | | | | | | | | |
|---|---|---|---|---|---|---|---|---|---|---|---|
| | Passing Time (hour) | | | | | | | | | | |
| | 0 | 3 | 6 | 9 | 12 | 15 | 18 | 21 | 24 | 27 | 30 |
| Evaluation | A | A | A | A | C | C | C | C | C | C | C |

TABLE 17

| TONER: (Fluorescent Magenta Toner + Magenta Toner), MODE: Resistance UP 1. COVERAGE RATE (Non-Fluorescent Image): 30%. COVERAGE RATE (Fluorescent Image): 100%. | | | | | | | | | | | |
|---|---|---|---|---|---|---|---|---|---|---|---|
| | Passing Time (hour) | | | | | | | | | | |
| | 0 | 3 | 6 | 9 | 12 | 15 | 18 | 21 | 24 | 27 | 30 |
| Evaluation | A | A | A | A | A | A | A | C | C | C | C |

TABLE 18

| TONER: (Fluorescent Magenta Toner + Magenta Toner), MODE: Resistance UP 2. COVERAGE RATE (Non-Fluorescent Image): 50%. COVERAGE RATE (Fluorescent Image): 100%. | | | | | | | | | | | |
|---|---|---|---|---|---|---|---|---|---|---|---|
| | Passing Time (hour) | | | | | | | | | | |
| | 0 | 3 | 6 | 9 | 12 | 15 | 18 | 21 | 24 | 27 | 30 |
| Evaluation | A | A | A | A | A | A | A | A | A | C | C |

As listed in Tables 7-9, when the light resistance UP mode images were formed using the fluorescent yellow toner and the yellow toner (Tables 8 and 9), compared with the case where the normal mode images were formed using only the fluorescent yellow toner (Table 7), the survival rate increased.

Specifically, in the case where the light resistance UP mode 1 images (the coverage rate of the non-luminescent image=30%) were formed using the fluorescent yellow toner and the yellow toner (Table 8), the survival rate increased compared with the case where the normal mode images were formed using only the fluorescent yellow toner (Table 7). Also, in the case where the light resistance UP mode 2 images (the coverage rate of the non-luminescent image=50%) were formed using the fluorescent yellow toner and the yellow toner (Table 9), the survival rate further increased compared with the case where the above-mentioned light resistance mode UP 1 images were formed (Table 8). This result indicates that the light resistance UP mode images become harder to discolor than the normal mode images.

Also, as listed in Tables 10-12, in the case where the light resistance UP mode images were formed using the fluorescent yellow toner and the yellow toner (Tables 11 and 12), the image quality became harder to decline compared with the case where the normal mode images were formed using only the fluorescent yellow toner (Table 10).

Specifically, in the case where the normal mode images were formed using only the fluorescent yellow toner (Table 10), although good image quality was obtained until 9 hours have passed, no good image quality was obtained once 9 hours have passed. As opposed to this, in the case where the light resistance UP mode 1 images were formed (Table 11), good image quality was obtained until 24 hours have passed, and in the case where the light resistance UP mode 2 images were formed (Table 12), good image quality was obtained even when 30 hours have passed. This result indicates that the image quality of the light resistance UP mode becomes harder to decline than the image quality of the normal mode.

Besides this, as listed in Tables 13-18, also in the case where the light resistance UP mode images were formed using the fluorescent magenta toner and the magenta toner, the same results were obtained as in the case where the light resistance UP mode images were formed using the fluorescent yellow toner and the yellow toner (Tables 7-12).

Specifically, as listed in Tables 13-15, in the case where the light resistance UP mode images were formed using the fluorescent magenta toner and the magenta toner (Tables 14 and 15), the survival rate increased compared with the case where the normal mode images were formed using only the fluorescent magenta toner (Table 13).

Also, as listed in Tables 16-18, in the case where the light resistance UP mode images were formed using the fluorescent magenta toner and the magenta toner (Tables 17 and 18), the image quality became harder to decline compared with the case where the normal mode images were formed using only the fluorescent magenta toner (Table 16).

Especially, in the case where the light resistance UP mode image were formed, despite the fact that a non-luminescent image and a luminescent image were superimposed with each other, little decline in the image quality due to color shifts etc. was confirmed.

Based on these, in the case where a normal mode image is formed, the tendency is that as time passes, the image is easy to discolor, and the image quality is easy to decline. As opposed to this, in the case where a light resistance UP mode image is formed, the tendency is that even as time passes, the image is hard to discolor, and the image quality is sufficiently retained.

Based on the results listed in Tables 1-18, non-luminescent toner is let adhere to an electrostatic latent image formed based on image data, also luminescent toner is let adhere to an electrostatic latent image formed based on the image data, and afterwards the non-luminescent toner and the luminescent toner are transferred and fused, thereby a non-luminescent image and a luminescent image are formed superimposed with each other on the surface of a medium. Thereby, the image becomes hard to discolor, and the image quality becomes easy to be retained, therefore a high-quality image was obtained.

Although this invention was explained above citing an embodiment, this invention is not limited by the mode explained by the one embodiment mentioned above, but various kinds of modifications are possible.

Specifically, for example, the image forming system of the image forming apparatus of the one embodiment of this invention is not limited to the intermediate transfer system using an intermediate transfer belt but can be another image forming system. Another image forming systems is, for example, an image forming system using no intermediate transfer belt, or the like. In the image forming system using no intermediate transfer belt, toner adhering to a latent image is not indirectly transferred to a medium through an intermediate transfer belt, but the toner adhering to the latent image is directly transferred to the medium.

Also, for example, the image forming apparatus of the one embodiment of this invention is not limited to a printer but can be a copier, a facsimile machine, a multifunction machine, or the like.

What is claimed is:

1. An image forming apparatus, comprising:

a first toner container that contains a non-luminescent toner and a second toner container that contains a luminescent toner;

a first development part that is provided with the first toner container, and forms a non-luminescent toner image by causing the non-luminescent toner, which is supplied from the first toner container, to adhere to a first latent image of an image generated from image data, a second development part that is provided with the second toner container, and forms a luminescent toner image by causing the luminescent toner, which is supplied from the second toner container, to adhere to a second latent image of the image generated from the image data, which is used for the first latent image, a transfer part that transfers the non-luminescent toner adhering to the first latent image and the luminescent toner adhering to the second latent image to a medium, and a fuser part that fuses the non-luminescent toner and the luminescent toner transferred to the medium, wherein the non-luminescent toner and the luminescent toner belong to the same type of colors, and the non-luminescent toner image and the luminescent toner image are transferred to the medium in a superimposed manner.

2. The image forming apparatus according to claim 1, wherein the luminescent toner is transferred to the medium where the non-luminescent toner has been transferred.

3. The image forming apparatus according to claim 1, wherein the non-luminescent toner is transferred to the medium where the luminescent toner has been transferred.

4. The image forming apparatus according to claim 1, wherein the luminescent toner contains at least one of a fluorescent coloring agent or a fluorescent whitening agent.

5. The image forming apparatus according to claim wherein the non-luminescent toner image contains a yellow image, and the luminescent toner image contains a fluorescent yellow image.

6. The image forming apparatus according to claim 1, wherein the non-luminescent toner image contains a magenta image, and the luminescent toner image contains a fluorescent magenta image.

7. The image forming apparatus according to claim 1, wherein a coverage rate of the non-luminescent toner image is ranged from 10% to 50% of a coverage rate of the luminescent toner image.

8. The image forming apparatus according to claim 1, wherein a coverage rate of the non-luminescent image is ranged from 10% to 30% of a coverage rate of the luminescent toner image.

9. The image forming apparatus according to claim 7, wherein the coverage rate is determined with an equation follow:

$$\eta = Sb/Sa \times 100(\%)$$

$\eta$: Quantity of the coverage rate

Sa: maximum area on which an exposure device is able to expose within a unit region of the medium Sb: exposed area on which the exposure device actually exposed in the unit region of the medium.

10. The image forming apparatus according to claim 1, wherein a color difference ($\Delta E$) between hue of the luminescent toner image and hue of the non-luminescent toner image and the luminescent toner image as transferred in the superimposed manner is 26.3 or below.

11. The image forming apparatus according to claim 1, wherein a color difference (⊿E) between hue of the luminescent toner image and hue of the non-luminescent toner image and the luminescent toner image as transferred in the superimposed manner is 18.4 or below.

12. The image forming apparatus according to claim 1, wherein a color difference (⊿E) between hue of the luminescent toner image and hue of the non-luminescent toner image and the luminescent toner image as transferred in the superimposed manner is 5.4 or below.

13. The image forming apparatus according to claim 1, wherein variations of hue of the non-luminescent toner image and the luminescent toner image as transferred in the superimposed manner relative to hue of the luminescent toner image are:

L*: less than 11.63%;

a*: less than 21.90%; and b*: less than 33.63%.

14. The image forming apparatus according to claim 1, wherein variations of hue of the non-luminescent toner image and the luminescent toner image as transferred in the superimposed manner relative to hue of the luminescent toner image are:

L*: less than 9.85%;

a*: less than 18.76%; and b*: less than 30.11%.

15. The image forming apparatus according to claim 1, wherein variations of hue of the non-luminescent toner image and the luminescent toner image as transferred in the superimposed manner relative to hue of the luminescent toner image are:

L*: less than 2.62%;

a*: less than 12.15%; and b*: less than 4.65%.

16. The image forming apparatus according to claim 1, wherein the luminescent toner image and the non-luminescent toner image are formed based on the image data that are common.

17. The image forming apparatus according to claim 1, wherein the luminescent toner image is formed on the medium after fixing the non-luminescent toner image on the medium.

18. The image forming apparatus according to claim 1, wherein the non-luminescent toner image is formed on the medium after fixing the luminescent toner image on the medium.

19. An image forming apparatus, comprising:

a first toner container that contains a non-luminescent toner and a second toner container that contains a luminescent toner;

a first development part that is provided with the first toner container, and causes the non-luminescent toner, which is supplied from the first toner container, to adhere to a first latent image formed based on image data, a second development part that is provided with the second toner container, and causes the luminescent toner, which is supplied from the second toner container, to adhere to a second latent image formed based on the image data, which is used for the first latent image, a transfer part that transfers the non-luminescent toner adhering to the first latent image and the luminescent toner adhering to the second latent image to a medium, and a fuser part that fuses the non-luminescent toner and the luminescent toner transferred to the medium, wherein the non-luminescent toner image and the luminescent toner image are superimposed such that one of the non-luminescent toner image and the luminescent toner image is directly disposed on the surface, and the other of the non-luminescent toner image and the luminescent toner image is disposed on the one on the surface, a coverage rate of the luminescent toner image is ranged from 10% to 50% of a coverage rate of the non-luminescent toner image, and the coverage rate is determined with an equation follow:

$$\eta = Sb/Sa \times 100(\%)$$

η: Quantity of the coverage rate

Sa: maximum area on which an exposure device is able to expose within a unit region of the medium Sb: exposed area on which the exposure device actually exposed in the unit region of the medium.

* * * * *